US010276329B2

(12) United States Patent
Shinohara et al.

(10) Patent No.: US 10,276,329 B2
(45) Date of Patent: Apr. 30, 2019

(54) MULTI-DIRECTION SWITCH

(71) Applicant: OMRON Corporation, Kyoto (JP)

(72) Inventors: Shoya Shinohara, Okayama (JP); Kenji Shinohara, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 15/826,290

(22) Filed: Nov. 29, 2017

(65) Prior Publication Data

US 2018/0082809 A1 Mar. 22, 2018

Related U.S. Application Data

(63) Continuation of application No. PCT/JP2016/073491, filed on Aug. 9, 2016.

(30) Foreign Application Priority Data

Aug. 31, 2015 (JP) ..... 2015-1710
Feb. 12, 2016 (JP) ..... 2016-0251

(51) Int. Cl.
*G05G 9/047* (2006.01)
*H01H 21/22* (2006.01)
(Continued)

(52) U.S. Cl.
CPC ..... *H01H 21/22* (2013.01); *G05G 9/047* (2013.01); *H01H 21/12* (2013.01); *H01H 21/36* (2013.01);
(Continued)

(58) Field of Classification Search
CPC ..... H01H 25/04; H01H 2221/012; H01H 2025/046; G05G 9/047; G05G 9/053; G05G 2009/04707
(Continued)

(56) References Cited

U.S. PATENT DOCUMENTS 3,598,943 A * 8/1971 Barrett ..... H01H 23/168 200/437
3,679,846 A * 7/1972 Dillon ..... H01H 25/04 200/556
(Continued)

FOREIGN PATENT DOCUMENTS

CN 201498418 U 6/2010
EP 0949555 A2 10/1999
(Continued)

OTHER PUBLICATIONS

International Search Report issued in PCT/JP2016/073491, dated Nov. 15, 2016 (2 pages).
(Continued)

*Primary Examiner* — Vanessa Girardi
(74) *Attorney, Agent, or Firm* — Osha Liang LLP

(57) ABSTRACT

A switch includes a base on which a bearing body having a bearing part at an upper end is provided in a protruding manner, an operating lever having an operating shaft with a lower end surface rotatably supported by the bearing part, and at least one operating leg extending from the operating shaft toward the base; and at least one contact mechanism having a fixed contact and a movable contact movable by the operating leg during rotation of the operating shaft, the contact mechanism being disposed on an upper surface of the base, with the movable contact opened and closed by the operating leg with respect to the fixed contact.

16 Claims, 29 Drawing Sheets

(51) Int. Cl.

| | |
|---|---|
| ***H01H 21/36*** | (2006.01) |
| ***H01H 25/04*** | (2006.01) |
| ***H01H 21/12*** | (2006.01) |
| *H01H 21/24* | (2006.01) |

(52) U.S. Cl.
CPC ... *H01H 25/04* (2013.01); *G05G 2009/04707* (2013.01); *H01H 21/24* (2013.01); *H01H 2235/01* (2013.01)

(58) Field of Classification Search
USPC ..... 200/6 A; 345/161
See application file for complete search history.

(56) References Cited

U.S. PATENT DOCUMENTS

| | | | | |
|---|---|---|---|---|
| 4,784,008 | A * | 11/1988 | Paquereau | G05G 5/05 200/6 A |
| 6,515,650 | B2 * | 2/2003 | Arita | G05G 9/047 345/156 |
| 6,787,716 | B1 | 9/2004 | Menche | |
| 6,852,938 | B2 * | 2/2005 | Nakade | H01H 25/041 200/18 |
| 2002/0190945 | A1 | 12/2002 | Arita et al. | |

FOREIGN PATENT DOCUMENTS

| | | | |
|---|---|---|---|
| JP | 59-033640 | U | 3/1984 |
| JP | 61-044735 | U | 3/1986 |
| JP | 2-31038 | U | 2/1990 |
| JP | H11-353109 | A | 12/1999 |
| JP | 2001-035318 | A | 2/2001 |
| JP | 2002-196880 | A | 7/2002 |

OTHER PUBLICATIONS

Written Opinion issued in PCT/JP2016/073491, dated Nov. 15, 2016 (6 pages).
Office Action issued in Chinese Application No. 201680028161.9 dated Sep. 19, 2018 (12 pages).

* cited by examiner

MULTI-DIRECTION SWITCH

TECHNICAL FIELD

The present invention relates to a switch, and particularly relates to a switch that is operable in multiple directions.

BACKGROUND

As a switch that is operable in multiple directions, for example, there have been a multi-directional switch assembly and a switch module (see Patent Document 1). As illustrated in FIG. 46, the multi-directional switch assembly and the switch module drive switch modules 101, 101' by an actuator 102.

PRIOR ART DOCUMENT

Patent Document

Patent Document 1: U.S. Pat. No. 6,787,716

SUMMARY OF THE INVENTION

Problems to be Solved by the Invention

However, in the multi-directional switch assembly and the switch module, the actuator 102 is assembled with an internal control unit 102*a* and an external control unit 102*b* by a universal joint around a guide pin 102*c*. Hence the multi-directional switch assembly has large numbers of parts and assembling steps, thus taking time and labor, and thus has low productivity, which has been problematic.

In view of the above problem, it is an object of the present invention to provide a switch with small numbers of parts and assembling steps and high productivity.

Means for Solving the Problem

According to one aspect of the present invention, in order to solve the problems, there is provided a switch including: a base on which a bearing body having a bearing part at an upper end is provided in a protruding manner; an operating lever having an operating shaft with a lower end surface (with a curved surface shape, for example, a curved concave shape, a spherical convex shape, or a spherical concave shape) rotatably supported by the bearing part, and at least one operating leg extending from the operating shaft toward the base; and at least one contact mechanism having a fixed contact and a movable contact capable of moving by the operating leg during rotation of the operating shaft, the contact mechanism being disposed on an upper surface of the base, with the movable contact opened and closed by the operating leg with respect to the fixed contact.

Effect of the Invention

According to the aspect of the present invention, by rotating an operating shaft of an operating lever, a contact mechanism can be directly driven by an operating leg extending from the operating shaft. It is thereby possible to obtain a switch with small numbers of parts and production steps and high productivity.

BRIEF DESCRIPTION OF THE DRAWINGS

These and other objects and features of the present invention will become apparent from the following description in conjunction with the embodiments with reference to the accompanying drawings. In this drawing.

MODES FOR CARRYING OUT THE INVENTION

Figure 1:
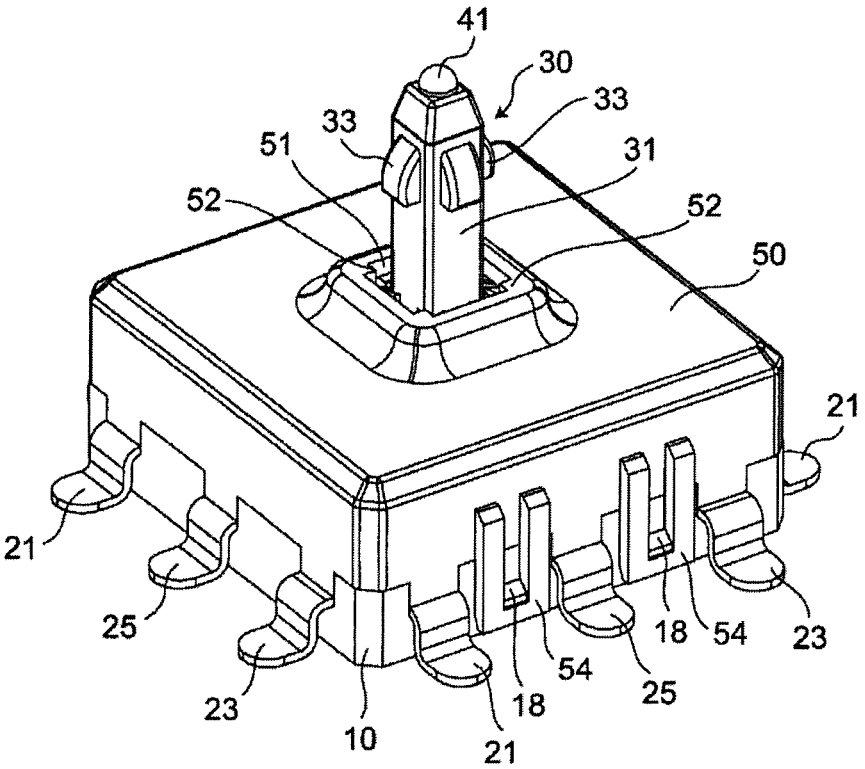
FIG. 1 is a perspective view illustrating a switch of a first embodiment according to the present invention.

Before continuing with the description of the present invention, the same reference numerals are provided to the same parts in the accompanying drawings.

Switches according to embodiments of the present invention will be described in accordance with the accompanied drawings of FIGS. 1 to 45.

In the following description, in describing configurations represented in the drawings, terms illustrating directions such as "up", "down", "left", and "right", and other terms including those, will be used. It is noted that the purpose for using those terms is to facilitate understanding of the embodiments through the drawings. Accordingly, those terms do not necessarily indicate directions used at the time of actually using the embodiments of the present invention. A technical scope of the invention recited in the claims shall not be restrictively interpreted by using those terms.

As illustrated in FIGS. 1 to 14, a switch according to a first embodiment is a switch that is operable in four directions as an example.

The switch includes at least a base 10, a pair of contact mechanisms 20, and an operating lever 30. That is, this switch includes: the base 10 in which a bearing body 11 having a bearing part 12 at an upper end is provided in a protruding manner; the operating lever 30 having an operating shaft 31 with a lower end surface rotatably supported by the bearing part 12, and at least one operating leg 35 extending from the operating shaft 31 toward the base 10; and at least the one contact mechanism 20 having a normally closed fixed contact 24 and a movable contact 28 movable by the operating leg 35 during rotation of the operating shaft 31, the contact mechanism 20 being disposed on an upper surface of the base 10, with the movable contact 28 opened and closed by the operating leg 35 with respect to the normally closed fixed contact 24.

Figure 5:
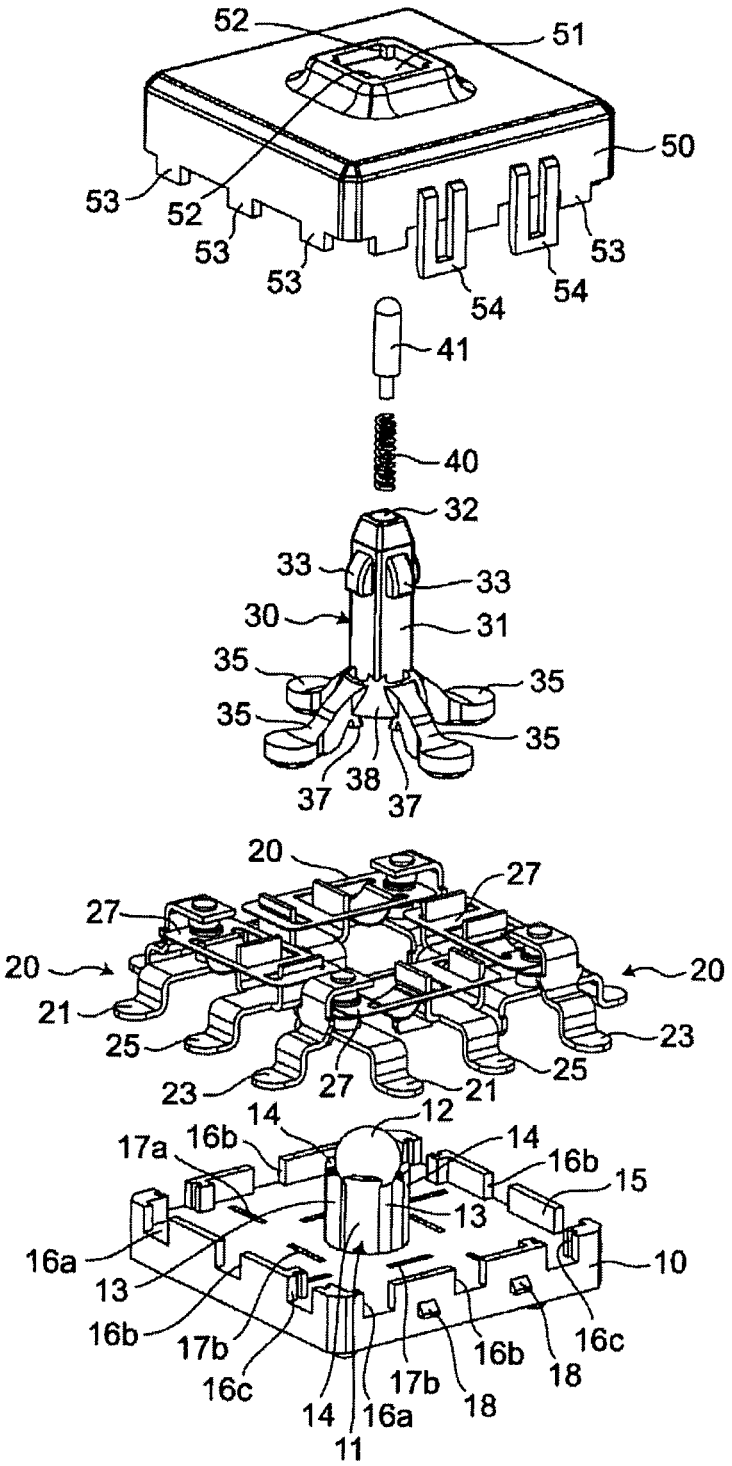
FIG. 5 is an exploded perspective view of the switch illustrated in FIG. 1.

As a more specific example, as illustrated in FIG. 5, the switch generally includes the base 10, four pairs of contact mechanisms 20, the operating lever 30, a coil spring 40, a pressure contact pin 41, and a cover 50. Note that the base 10, the operating lever 30, and the cover 50 are made of an insulating synthetic resin or the like.

The base 10 is a planar square plate-shaped body, and the bearing body 11 is provided in a protruding manner at the center of the upper surface of the base 10. The bearing body 11 is provided with the bearing part 12 having a spherical surface shape at the upper end thereof. A guide groove 13 penetrating the base 10 is formed in the base of the bearing part 12 along an axial direction. The guide groove 13 is formed in a place where a core of a molding die for molding the bearing body 11 is disposed. A plurality of support receiving parts 14 having a substantially fan shape in cross section are integrally molded on the outer peripheral surface of the bearing body 11 along the axial direction. Therefore, the guide groove 13 is disposed between the support receiving parts 14, 14.

Further, the base 10 has an annular rib 15 formed along the outer peripheral edge of the upper surface thereof. The annular rib 15 is provided with notches 16*a*, 16*b*, 16*c* for respectively assembling a normally open fixed contact terminal 21, a movable contact terminal 25, and a normally closed fixed contact terminal 23 described later. In particular, a press-fit groove for press-fitting the normally closed fixed contact terminal 23 is formed on the facing counter surface of the notch 16*c*. A pair of locking protrusions 18, 18 provided in a protruding manner on the facing outer surfaces of the base 10. A positioning protrusion 19 (FIG. 6) is provided in a protruding manner at the corner of the lower surface of the base 10.

Figure 7:
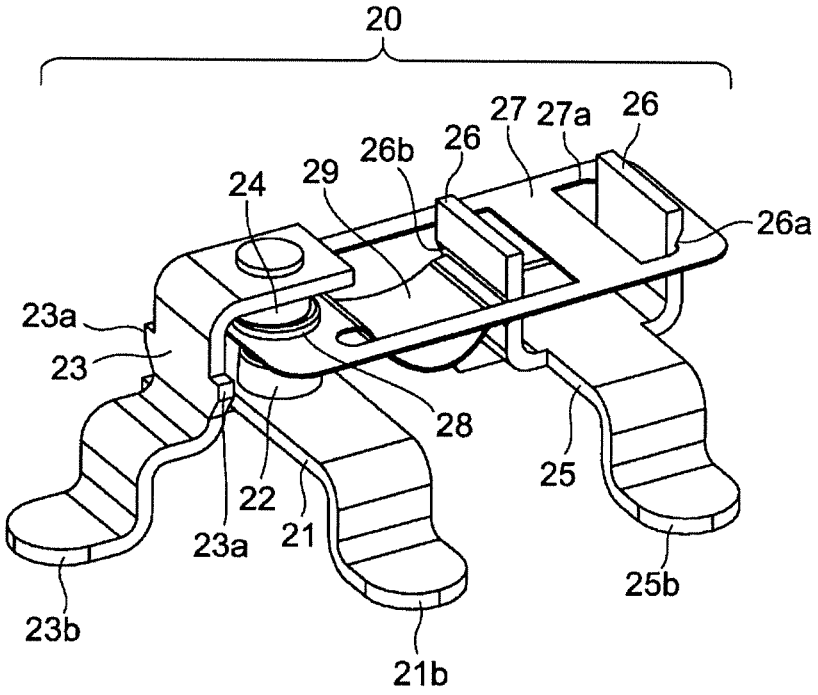
FIG. 7 is a perspective view illustrating a contact mechanism illustrated in FIG. 5.
Figure 8:
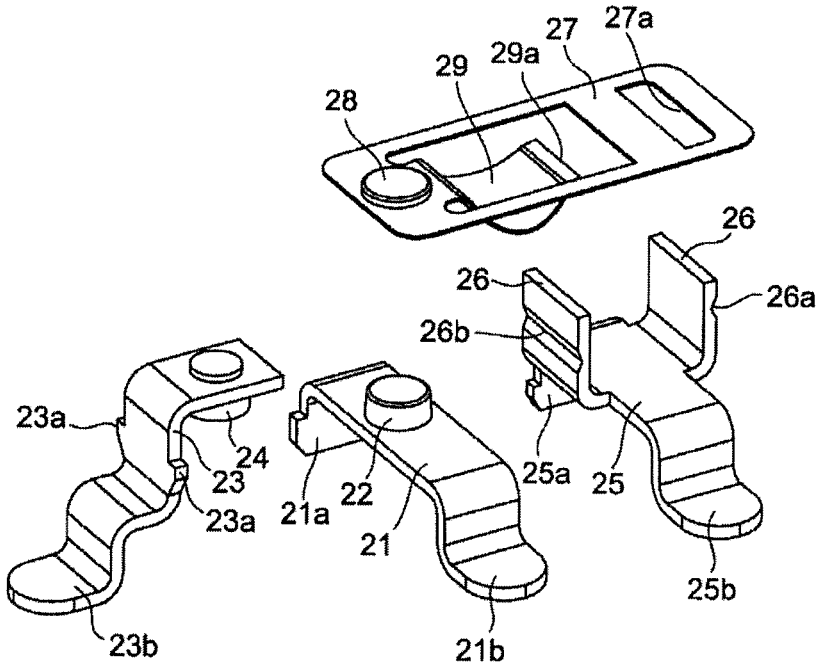
FIG. 8 is an exploded perspective view of the contact mechanism illustrated in FIG. 7.

As illustrated in FIGS. 7 and 8, the contact mechanism 20 is made up of the normally open fixed contact terminal 21, the normally closed fixed contact terminal 23, the movable contact terminal 25, and a movable touch piece 27.

The normally open fixed contact terminal 21 has a normally open fixed contact 22 fixed to the central part thereof, for example, caulked and fixed. The normally open fixed contact terminal 21 is bent at one end thereof to form a press-fit part 21*a*, while the other end thereof is bent to serve as a terminal part 21*b*.

Press-fit protrusions 23*a* are provided in a protruding manner on both side end surfaces of the center part of the normally closed fixed contact terminal 23. Further, the normally closed fixed contact terminal 23 is bent at one end thereof, and the normally closed fixed contact 24 is fixed, for example, caulked and fixed, while the other end thereof is bent to serve as a terminal part 23*b*.

The movable contact terminal 25 is bent and raised at both side edges of the center part thereof so as to face each other, thereby forming a pair of rising pieces 26, 26. The rising pieces 26, 26 have locking grooves 26*a*, 26*b* formed on the facing outer surfaces. Moreover, the movable contact terminal 25 is bent at the one end thereof to form a press-fit part 25*a*, and is bent at the other end to form a terminal part 25*b*.

The movable touch piece 27 is a conductive thin plate material having a planar rectangular shape, and the movable contact 28 is fixed, for example, caulked and fixed to one end thereof, and an inversion spring 29 is cut out from the one end thereof. The inversion spring 29 has a substantially barrel side surface shape and is curved in a plate thickness direction. Further, the movable touch piece 27 is provided with an engaging hole 27*a* at the other end thereof.

Then, as illustrated in FIG. 5, the press-fit part 21*a* of the normally open fixed contact terminal 21 and the press-fit part 25*a* of the movable contact terminal 25 are respectively press-fitted into terminal holes 17*a*, 17*b* of the base 10, and assembled. As illustrated in FIGS. 7 and 8, the opening edge of the engaging hole 27*a* of the movable touch piece 27 is locked in the locking groove 26*a* provided in the rising piece 26 of the movable contact terminal 25. A free end 29*a* of the inversion spring 29 is locked in the locking groove 26*b* provided in the other remaining rising piece 26. Accordingly, the movable contact 28 contactably and separably faces the normally open fixed contact 22.

Further, the press-fit protrusion 23*a* of the normally closed fixed contact terminal 23 is press-fitted into the press-fit groove provided in the notch 16*c* of the base 10 and assembled. Thereby, the movable contact 28 and the normally closed fixed contact 24 contactably and separably face each other.

In the first embodiment, the four pairs of contact mechanisms 20 are arranged point-symmetrically about the bearing body 11 of the base 10. Further, all of the components of the contact mechanism 20 can be assembled from above the base 10. Therefore, by rotating the base 10 around the bearing body 11, the contact mechanism 20 can be continuously assembled to the base 10 by an automatic assembling machine.

As illustrated in FIG. 5, the operating lever 30 is provided with the operating shaft 31 having a substantially square shape in cross section, and an insertion hole 32 is formed in the upper end surface of the operating shaft 31. The coil spring 40 and the pressure contact pin 41 are inserted into the insertion hole 32. An engaging claw part 33 is provided in a protruding manner at the upper end of each outer surface of the operating shaft 31.

Figure 3:
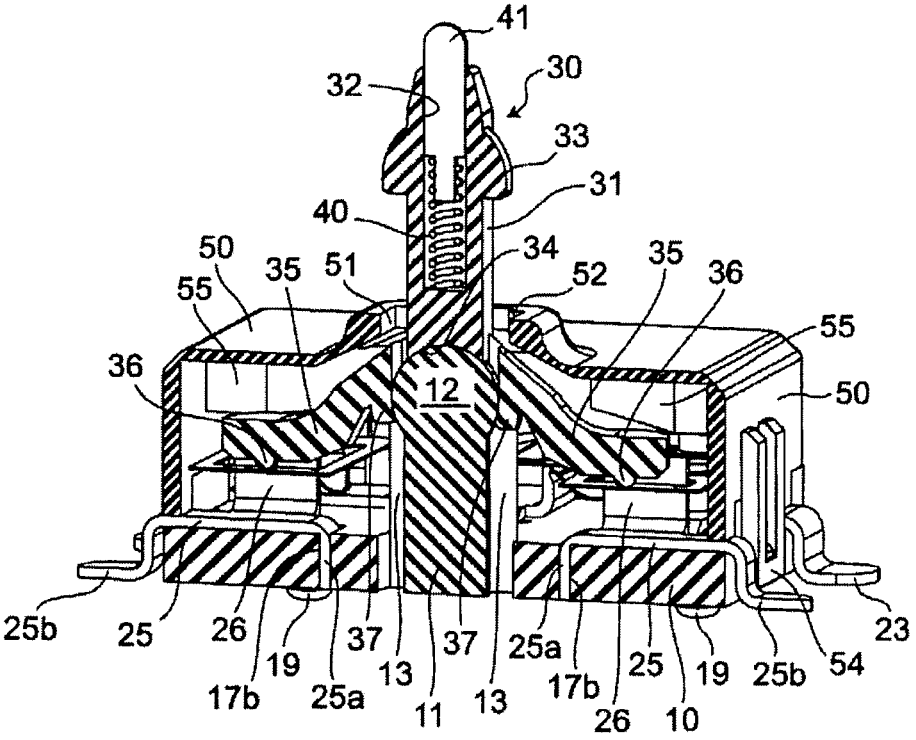
FIG. 3 is a longitudinal cross-sectional perspective view of the switch illustrated in FIG. 1 cut at a position different from that in FIG. 2.
Figure 4:
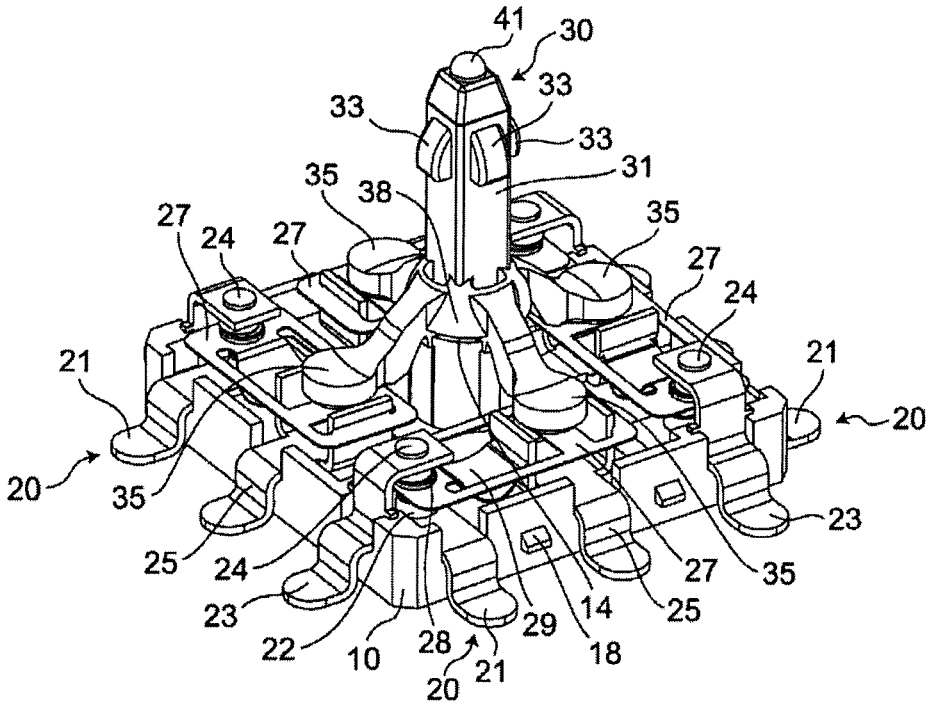
FIG. 4 is a perspective view illustrating a state where a cover has been removed from the switch illustrated in FIG. 1.
Figure 9:
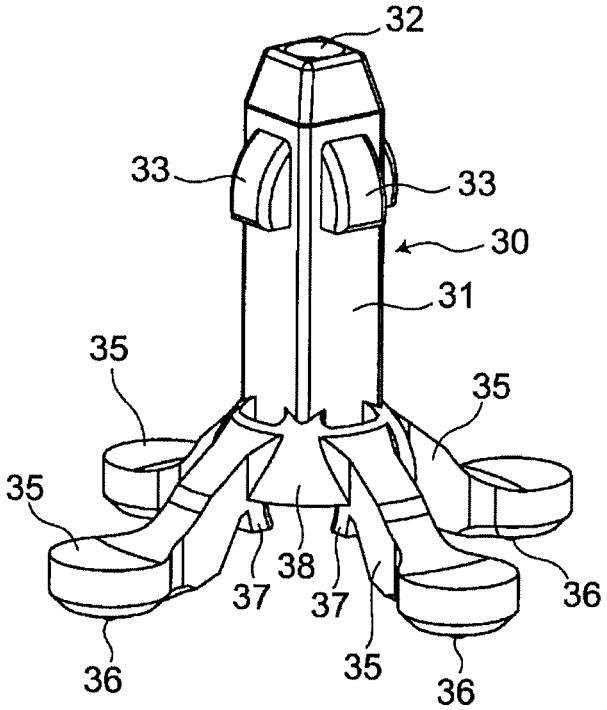
FIG. 9 is a perspective view of an operating lever illustrated in FIG. 5.
Figure 10:
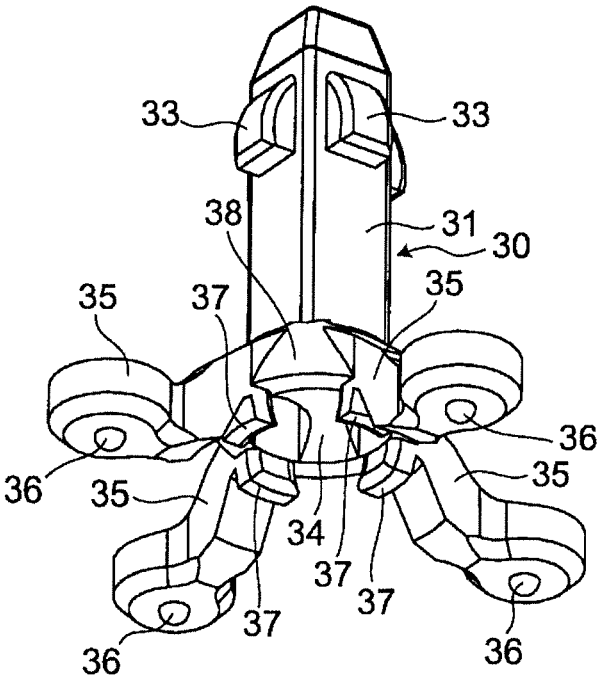
FIG. 10 is a perspective view of the operating lever illustrated in FIG. 5, seen from a different angle.

Further, as illustrated in FIG. 3, the operating shaft 31 has a spherical concave part 34 that can be brought into surface contact with the bearing part 12, which has a spherical surface shape, of the bearing body 11 on the lower end surface of the operating shaft 31. From the lower end of the operating shaft 31, at least one operating leg 35, for example, four operating legs 35, extends obliquely downward uniformly, for example (FIGS. 9 and 10). An operating protrusion 36 is provided in a protruding manner on the lower surface of the free end of the operating leg 35. The operating leg 35 is provided with a retaining rib 37 which can be elastically engaged with an annular base of the bearing part 12 on the lower surface base thereof (FIG. 3). Further, a position regulating rib 38 for preventing erroneous operation is integrally provided between the adjacent operating legs 35, 35 (FIG. 4).

Figure 12:
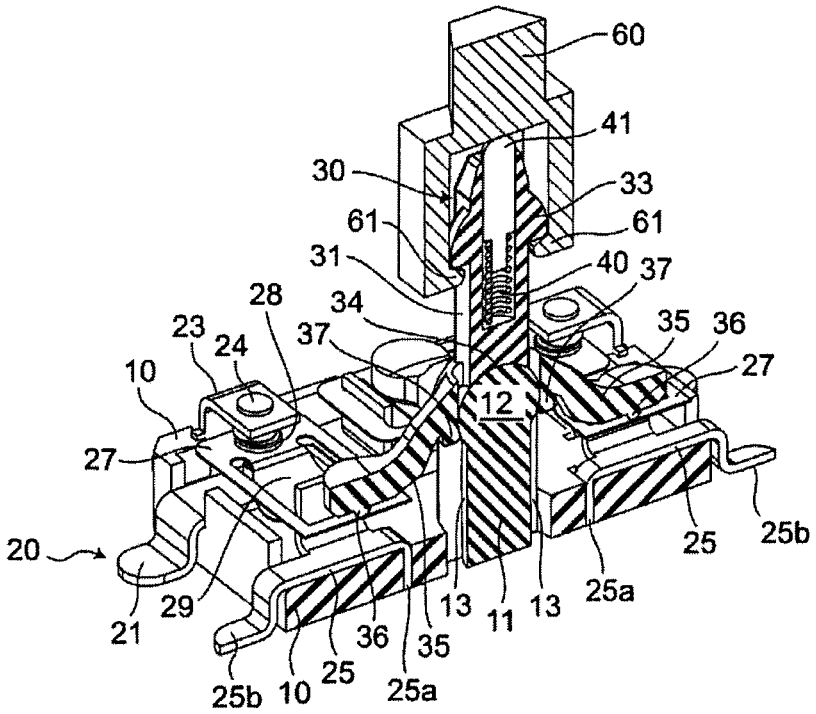
FIG. 12 is a longitudinal cross-sectional perspective view of a state where the cover has been removed from the switch of FIG. 11.
Figure 13:
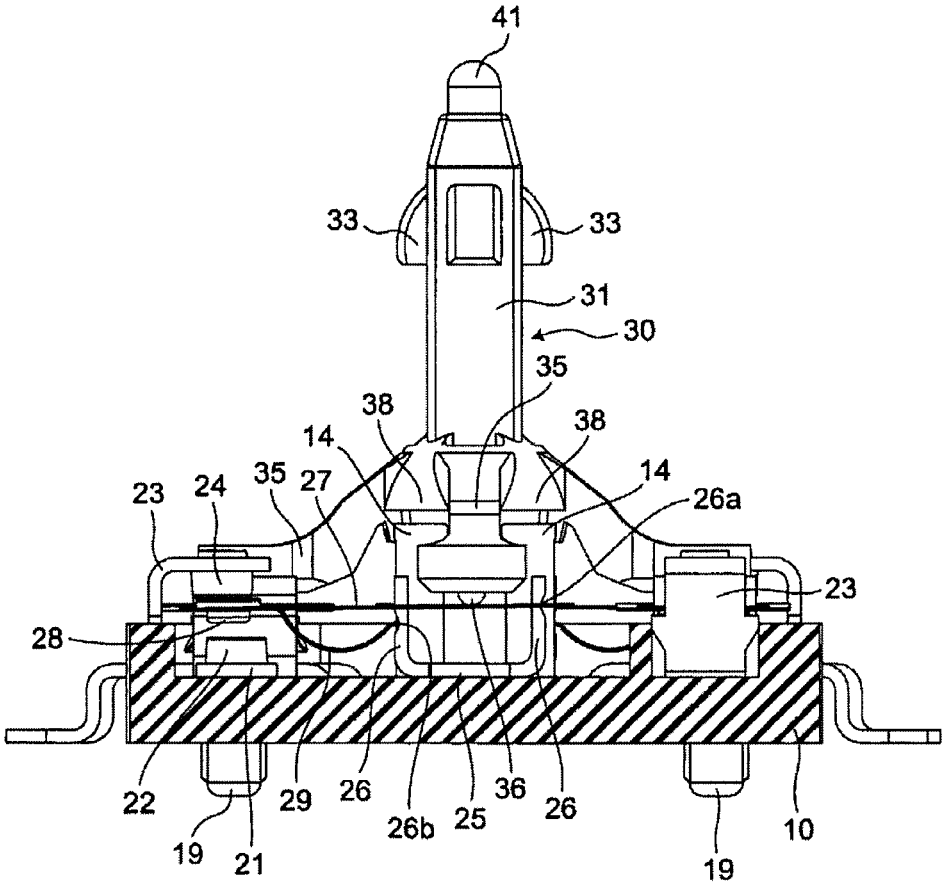
FIG. 13 is a cross-sectional view illustrating the switch illustrated in FIG. 4 before operation.

As illustrated in FIG. 12, the spherical concave part 34 of the operating lever 30 is fitted to the bearing part 12 of the base 10, so that the retaining rib 37 is elastically engaged with the annular base of the bearing part 12 to serve as a coming-off stopper. Thus, the operating lever 30 and the bearing part 12 are assembled in a single operation. This can prevent the operating lever 30 from falling off and causing rattling. The operating protrusion 36 of the operating leg 35 is pressed against the movable touch piece 27, and the retaining rib 37 is fitted into the guide groove 13. Further as illustrated in FIG. 13, the position regulating rib 38 comes into contact with the support receiving part 14 of the base 10 and faces the support receiving part 14 so as to regulate its position.

Figure 6:
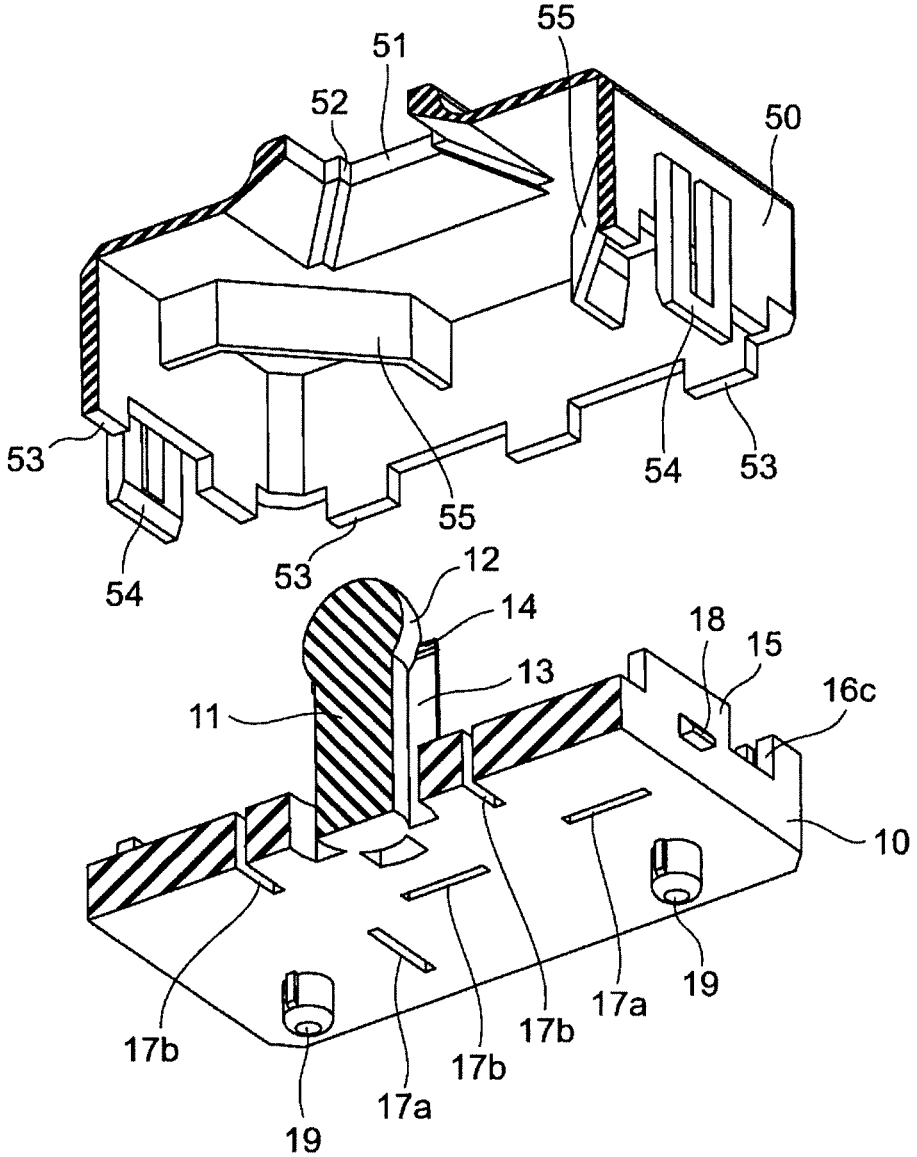
FIG. 6 is a cross-sectional perspective view illustrating a base and the cover illustrated in FIG. 5.

As illustrated in FIGS. 5 and 6, the cover 50 has a box shape with a plane fittable to the base 10. Further, the cover 50 is provided with an operating hole 51 having a planar square shape on the ceiling surface thereof. At each corner of the operating hole 51, a position regulating protrusion 52 is provided. A fitting protrusion 53, fitted in each of the notches 16*a*, 16*b*, 16*c* of the base 10, is provided in a protruding manner at an opening edge of the cover 50. Further, a pair of locking parts 54 which have a substantially U-shape and can be engaged with the locking protrusions 18 of the base 10 is provided on the facing outer surfaces of the cover 50. Then, as illustrated in FIG. 6, the cover 50 is provided with a partition wall 55 so as to bridge the inner surfaces adjacent to each other in the internal space. The partition wall 55 functions as a reinforcing member to increase the rigidity of the cover 50.

Figure 2:
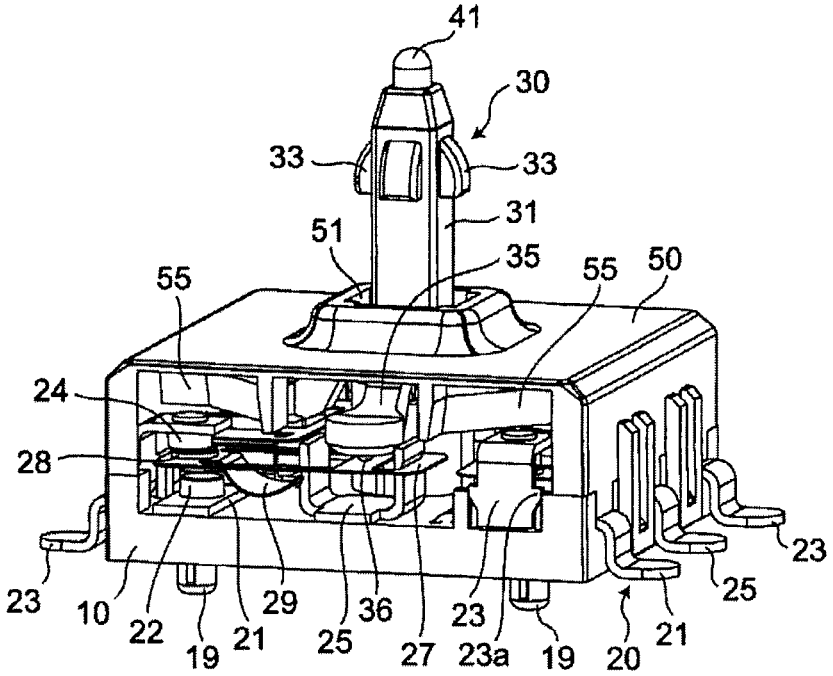
FIG. 2 is a longitudinal cross-sectional perspective view of the switch illustrated in FIG. 1.

Then, as illustrated in FIG. 2, the cover 50 is put on the base 10 assembled with the contact mechanism 20 and the operating lever 30. Then, the fitting protrusions 53 of the cover 50 are fitted into the notches 16*a*, 16*b*, 16*c* provided in the annular rib 15 of the base 10. Further, the locking part 54 of the cover 50 is locked to the locking protrusion 18 of the base 10. Thereby, the operating lever 30 protrudes from the operating hole 51 of the cover 50 so as to be operable.

The partition wall 55 of the cover 50 is disposed at a position that partitions the normally closed fixed contact 24 and the movable contact 28, which contactably and separably face each other, away from the internal space. Hence it is possible to prevent adverse effects due to an arc generated at the time of switching the contacts, dust accompanying the arc, and the like.

Figure 11:
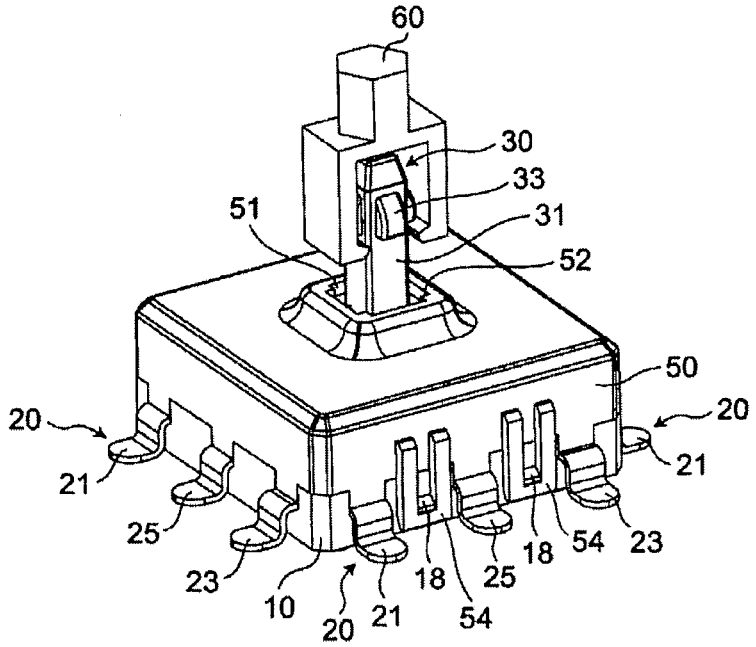
FIG. 11 is a perspective view illustrating a state where an operating body has been attached to the switch of FIG. 1.

For example, as illustrated in FIGS. 11 and 12, a pair of engaging arms 61, 61 of an operating body 60 may be engaged with the engaging claw parts 33 of the operating shaft 31 on the operating lever 30. In the first embodiment, the pressure contact pin 41 biased by the spring force of the coil spring 40 is pressed against the operating body 60. Therefore, rattling of the operating body 60 does not occur and there is no possibility of falling off.

Next, a method for operating the switch will be described.

First, as illustrated in FIG. 13, before the operating lever 30 is operated, the operating protrusion 36 of the operating lever 30 is in contact with the movable touch piece 27. The movable contact 28 is in contact with the normally closed fixed contact 24, and is separated from the normally open fixed contact 22.

Figure 14:
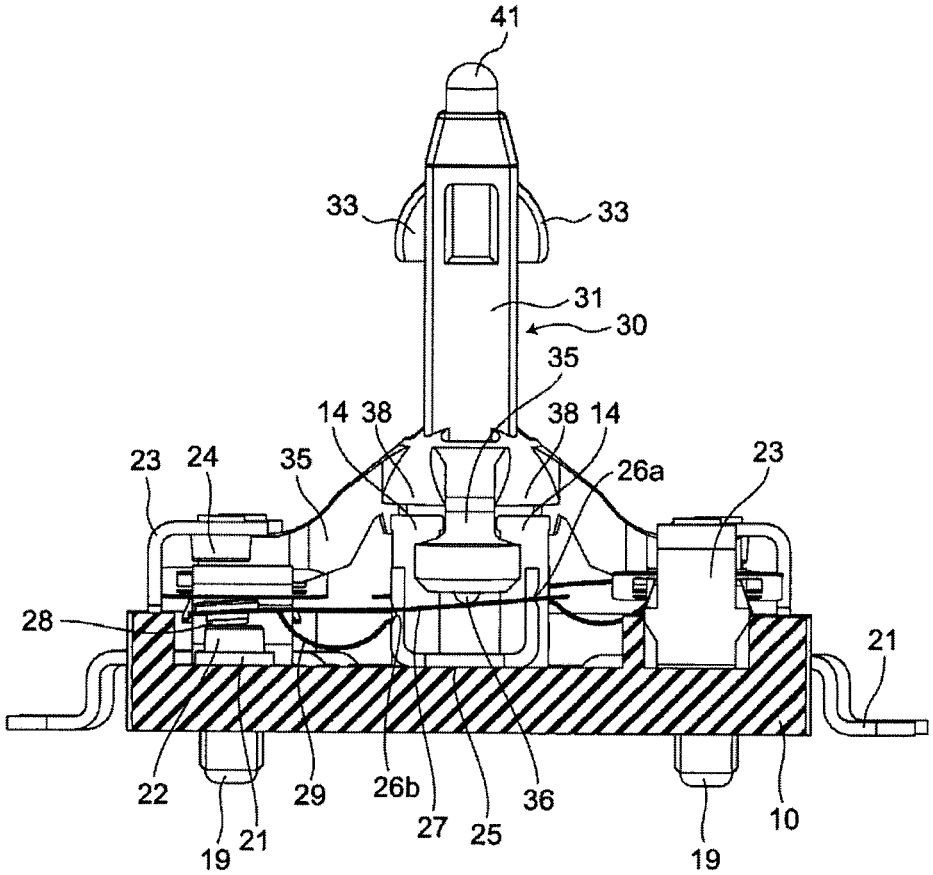
FIG. 14 is a cross-sectional view illustrating the switch illustrated in FIG. 4 after operation.

When the operating lever 30 is rotated and inclined to the front side in FIG. 13, the operating protrusion 36 of the inclined operating leg 35 pushes down the movable touch piece 27. When an operating point of the operating protrusion 36 exceeds a reference line (not illustrated) connecting the locking groove 26*a* and the locking groove 26*b*, the movable touch piece 27 is instantaneously elastically deformed and inverted by the spring force of the inversion spring 29. Hence the movable contact 28 instantaneously switches from the normally closed fixed contact 24 to the normally open fixed contact 22 (FIG. 14).

Subsequently, when the load on the operating lever 30 is eliminated, the operating leg 35 is pushed back by the spring force of the movable touch piece 27. Therefore, when the operating point of the operating protrusion 36 exceeds the reference line connecting the locking groove 26*a* and the locking groove 26*b*, the movable touch piece 27 returns to its original shape by the spring force of the inversion spring 29. As a result, the movable contact 28 is separated from the normally open fixed contact 22 and comes into contact with the normally closed fixed contact 24, whereby the original state is restored.

Note that the position regulating ribs 38 provided between the adjacent operating legs 35, 35 comes into contact with the support receiving part 14 of the bearing body 11 and faces the support receiving part 14 so as to regulate its position. Thus, when the operating lever 30 is rotated in a direction other than the predetermined direction, the position regulating rib 38 comes into contact with the support receiving part 14 and the position thereof is regulated. Since the operating lever 30 can no longer be rotated in the direction other than the predetermined direction, erroneous operation of the operating lever 30 can be prevented.

Further, in the switch, the retaining rib 37 provided on the lower surface base of the operating leg 35 is fitted in the guide groove 13 of the bearing body 11 and guided (FIG. 12). There is thus an advantage that erroneous operation of the operating lever 30 can be more reliably prevented.

Figure 15:
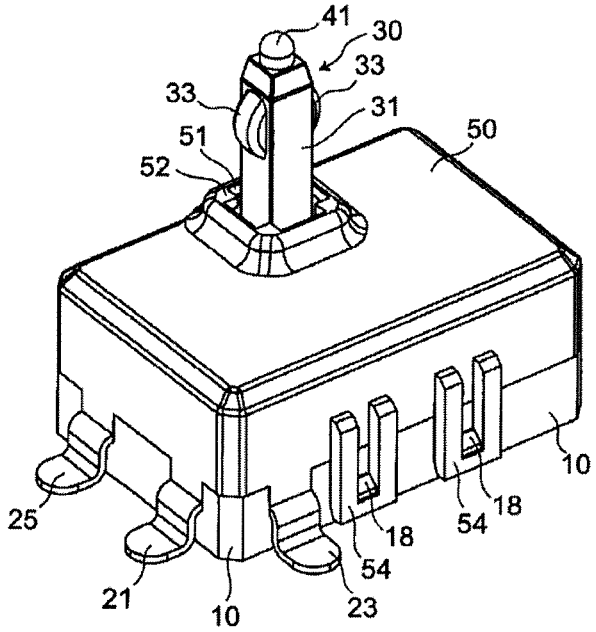
FIG. 15 is a perspective view illustrating a switch of a second embodiment according to the present invention.
Figure 16:
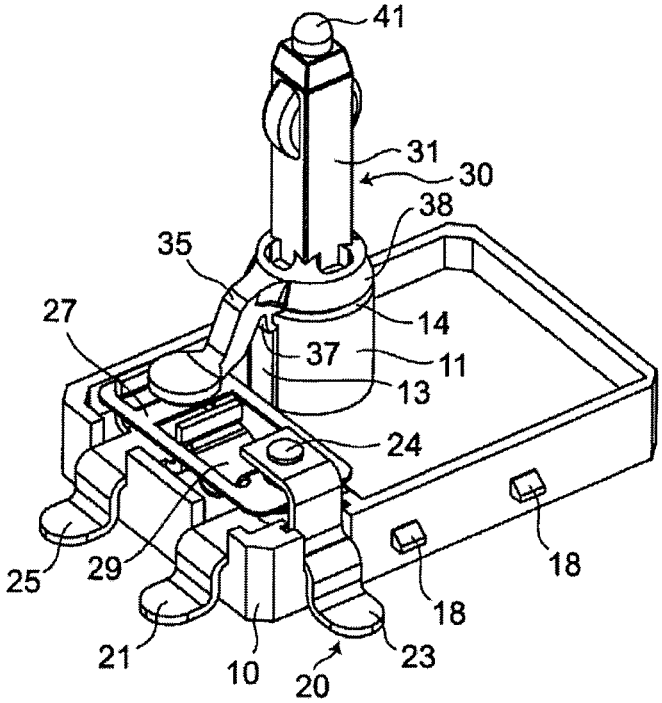
FIG. 16 is a perspective view illustrating a state where a cover has been removed from the switch illustrated in FIG. 15.

A second embodiment is a case where, as illustrated in FIGS. 15 and 16, a switch incorporating one pair of contact mechanisms 20 is applied.

In the second embodiment, in order to prevent erroneous operation of an operating lever 30, a position regulating rib 38, having an arcuate shape, of the operating lever 30 comes into contact with a support receiving part 14 having an arcuate shape in cross section of a bearing body 11 and faces the support receiving part 14 so as to regulate its position. Therefore, when the operating lever 30 is rotated in a direction other than the predetermined direction, the position regulating rib 38 comes into contact with the support receiving part 14 for positional regulation, whereby it is possible to prevent erroneous operation of the operating lever 30.

Further, a retaining rib 37 provided on the lower surface base of an operating leg 35 is fitted in a guide groove 13 of the bearing body 11 and guided (FIG. 16). There is thus an advantage that erroneous operation of the operating lever 30 can be more reliably prevented.

The other parts of the second embodiment are substantially the same as those of the first embodiment described above, and hence the same reference numerals are provided to the same parts, and the description thereof is omitted.

Figure 17:
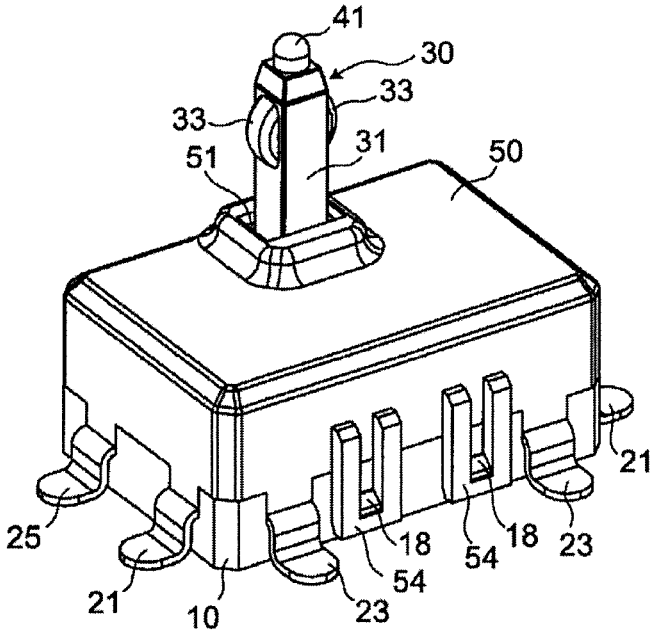
FIG. 17 is a perspective view illustrating a switch of a third embodiment according to the present invention.
Figure 18:
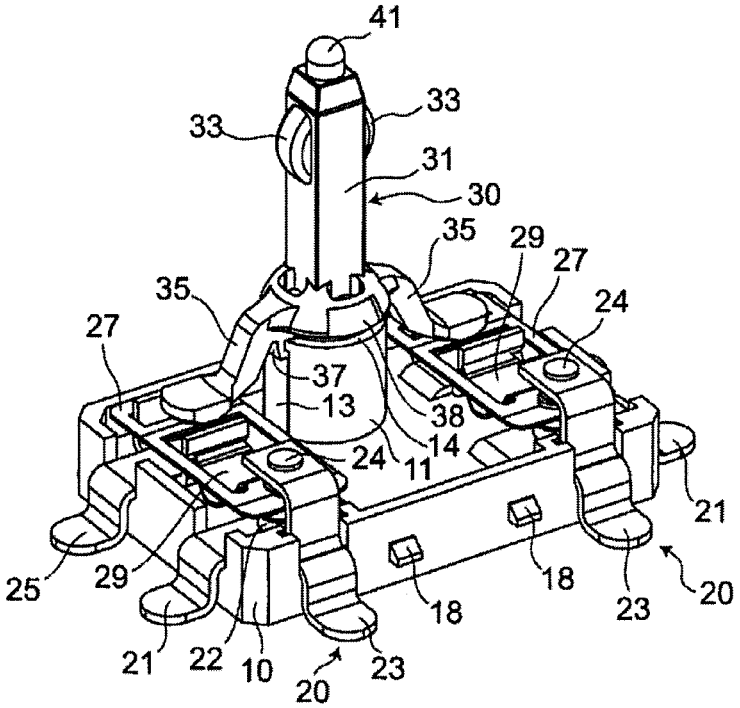
FIG. 18 is a perspective view illustrating a state where a cover has been removed from the switch illustrated in FIG. 17.

A third embodiment is a case where, as illustrated in FIGS. 17 and 18, contact mechanisms 20, 20 are provided side by side on the both sides of a bearing body 11, while a pair of operating legs 35, 35 extend on the same straight line in an operating lever 30.

The other parts of the third embodiment are substantially the same as those of the first embodiment described above, and hence the same reference numerals are provided to the same parts, and the description thereof is omitted.

A fourth embodiment is a case (FIG. 21) where, as illustrated in FIGS. 19 to 22, in a housing formed by putting a base 10 having a planar regular octagonal shape on a cover 50 having a planar regular octagonal box shape, eight pairs of contact mechanisms 20 are radially arranged around a bearing body 11.

Figure 19:
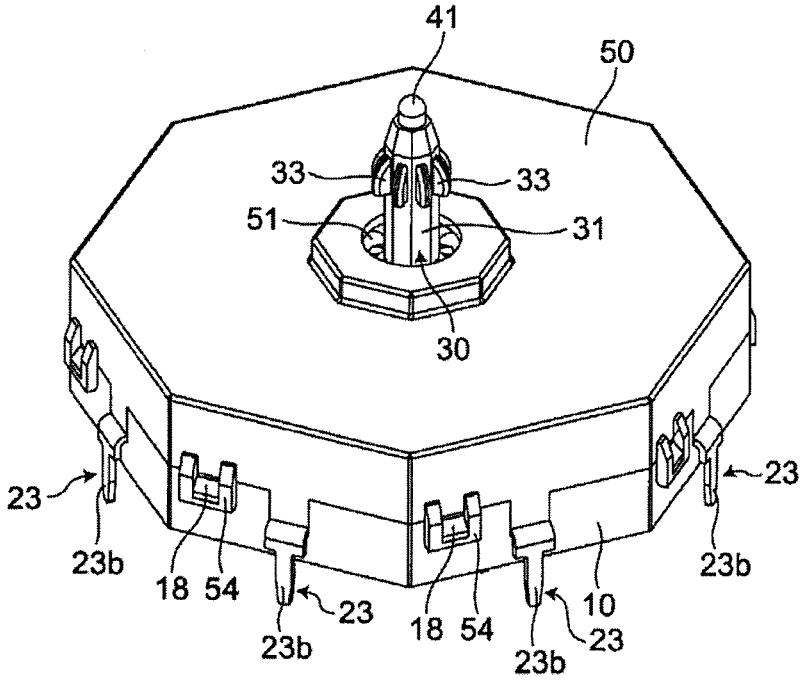
FIG. 19 is a perspective view illustrating a switch of a fourth embodiment according to the present invention.
Figure 20:
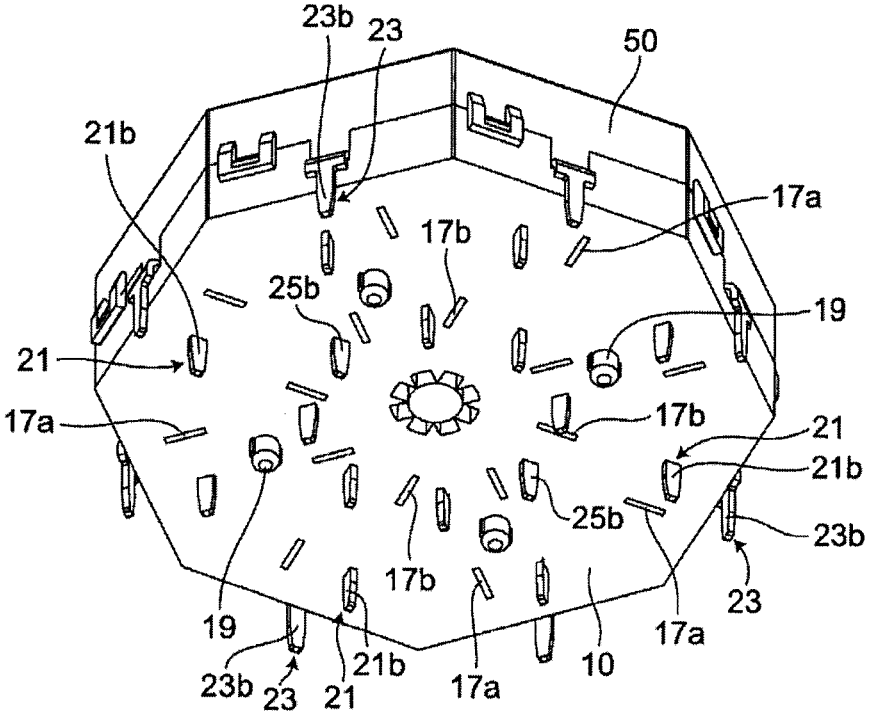
FIG. 20 is a perspective view of the switch illustrated in FIG. 19, seen from a different angle.
Figure 21:
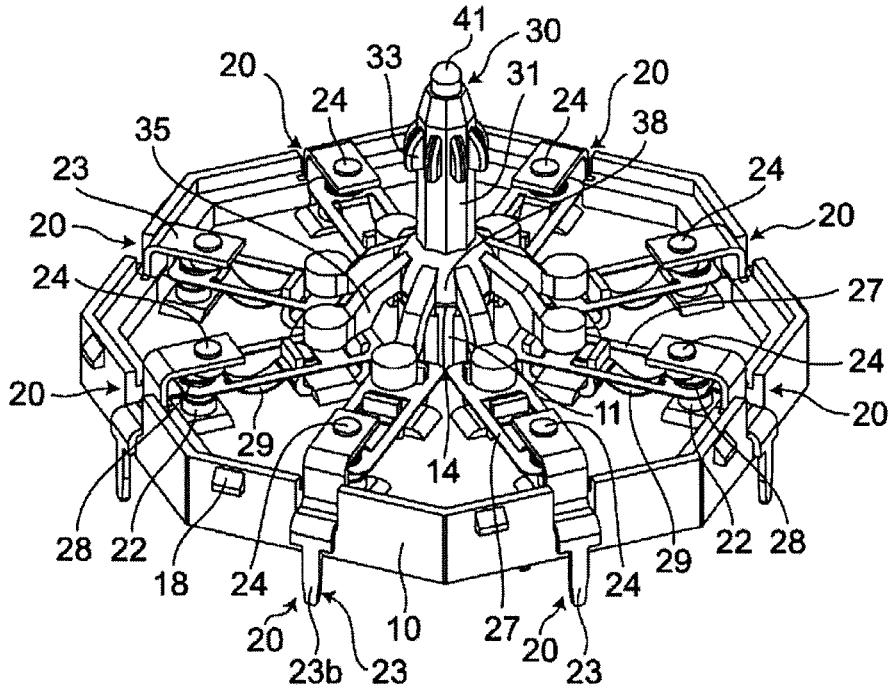
FIG. 21 is a perspective view illustrating a state where a cover has been removed from the switch illustrated in FIG. 19.

In the fourth embodiment, an operating hole 51 having a planar circular shape is provided on the ceiling surface of the cover 50 (FIG. 19). Further, terminal parts 21*b*, 23*b*, 25*b* have such shapes that they can be inserted into the through holes of a printed circuit board (not illustrated) (FIG. 20).

Figure 22:
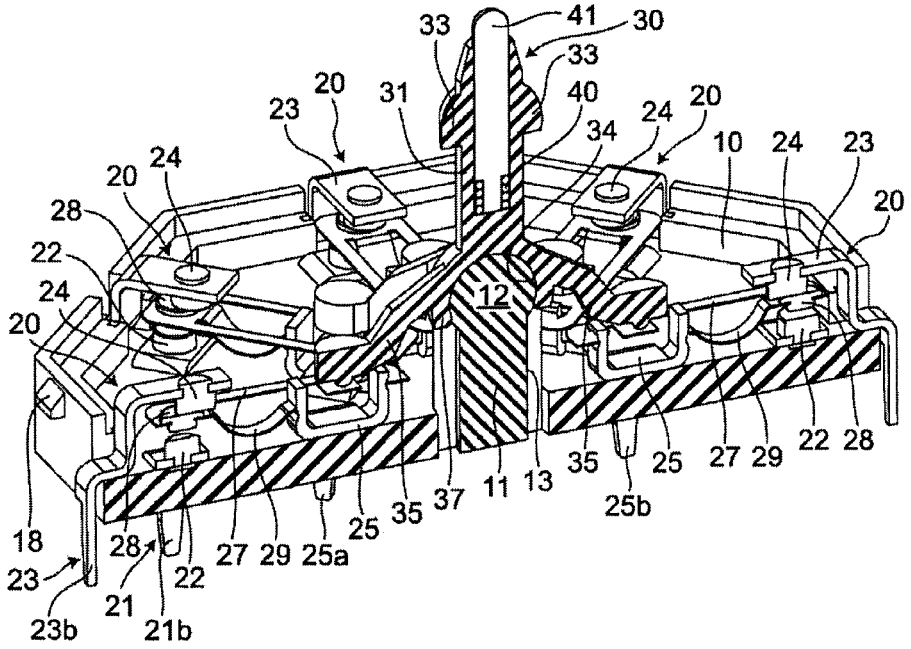
FIG. 22 is a longitudinal cross-sectional perspective view of FIG. 21.
Figure 23:
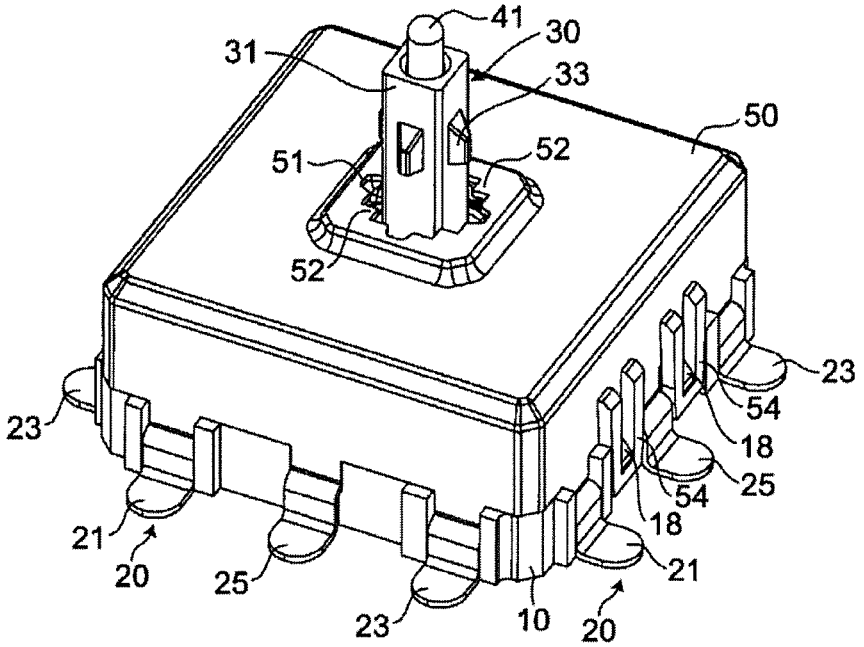
FIG. 23 is a perspective view illustrating a switch of a fifth embodiment according to the present invention.
Figure 24:
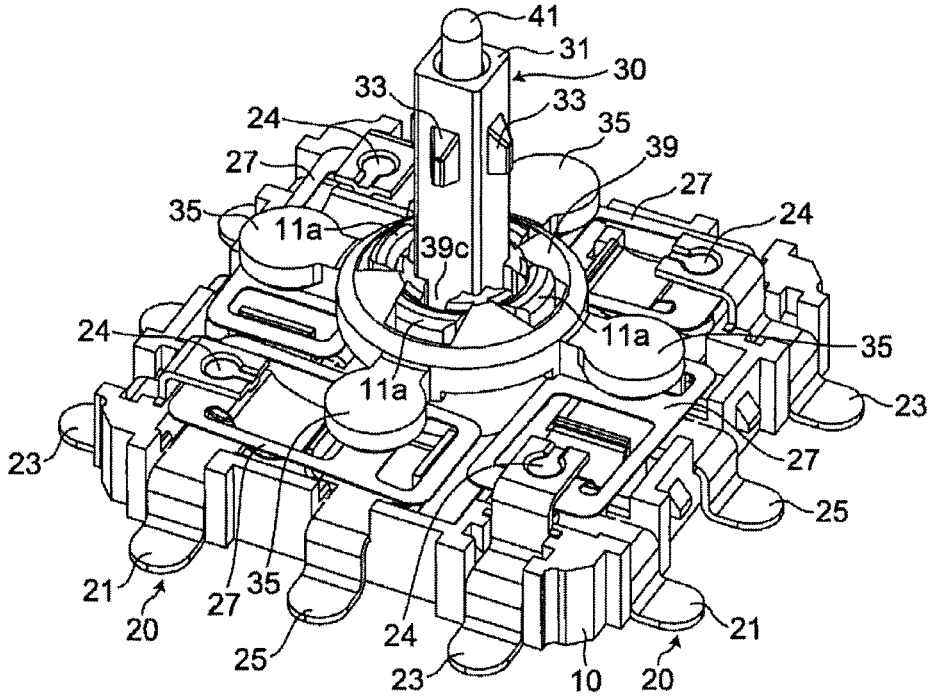
FIG. 24 is a perspective view illustrating a state where a cover has been removed from the switch illustrated in FIG. 23.

According to the fourth embodiment, as illustrated in FIG. 22, operation in eight directions can be detected by operating an operating lever 30 around the bearing body 11 having a bearing part 12 with a spherical surface shape. There is thus an advantage that a versatile switch can be obtained.

The other parts of the fourth embodiment are substantially the same as those of the first embodiment described above, and hence the same reference numerals are provided to the same parts, and the description thereof is omitted.

Figure 25:
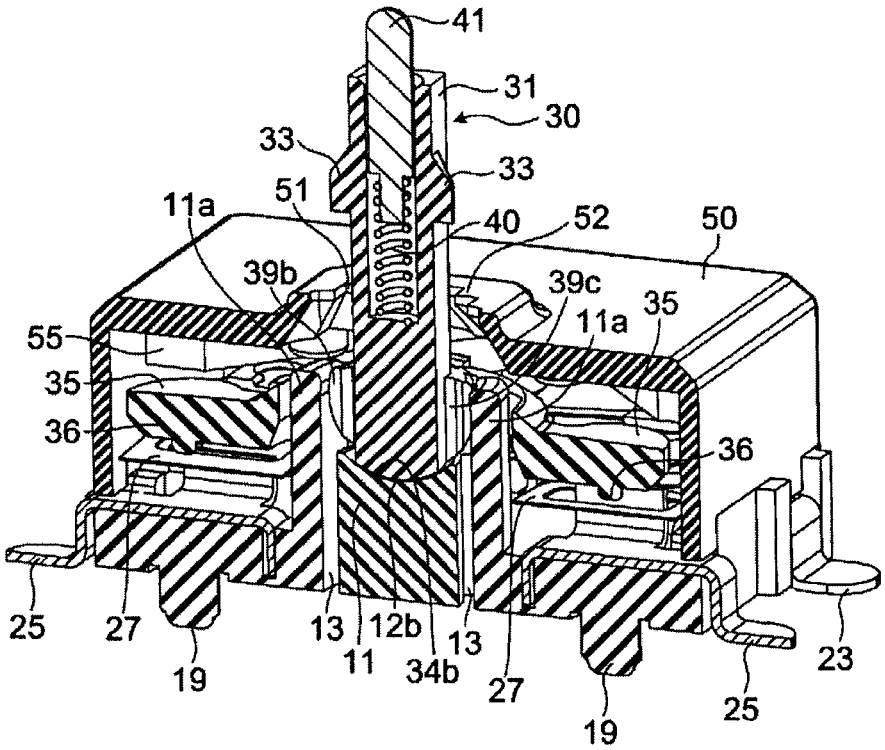
FIG. 25 is a longitudinal cross-sectional perspective view of the switch illustrated in FIG. 23.

A fifth embodiment illustrates a switch that is operable in four directions as illustrated in FIGS. 23 to 33. This is substantially the same as in the first embodiment, and different in that, as illustrated in FIG. 25, a spherical convex part 34*b* of an operating lever 30 is supported by a bearing part 12*b* having a curved concave surface shape, for example, a spherical concave surface shape, provided on a base 10.

Figure 26:
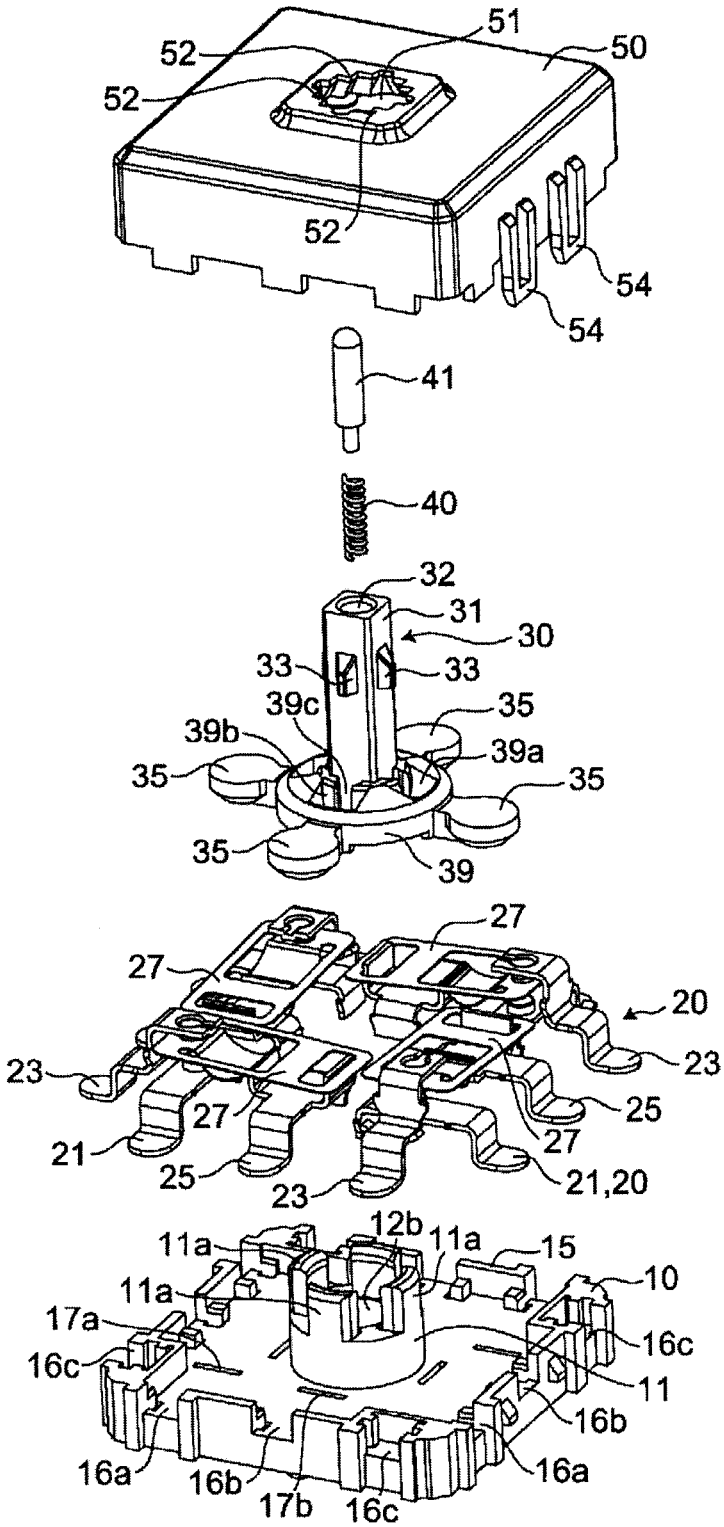
FIG. 26 is an exploded perspective view of the switch illustrated in FIG. 23.
Figure 28:
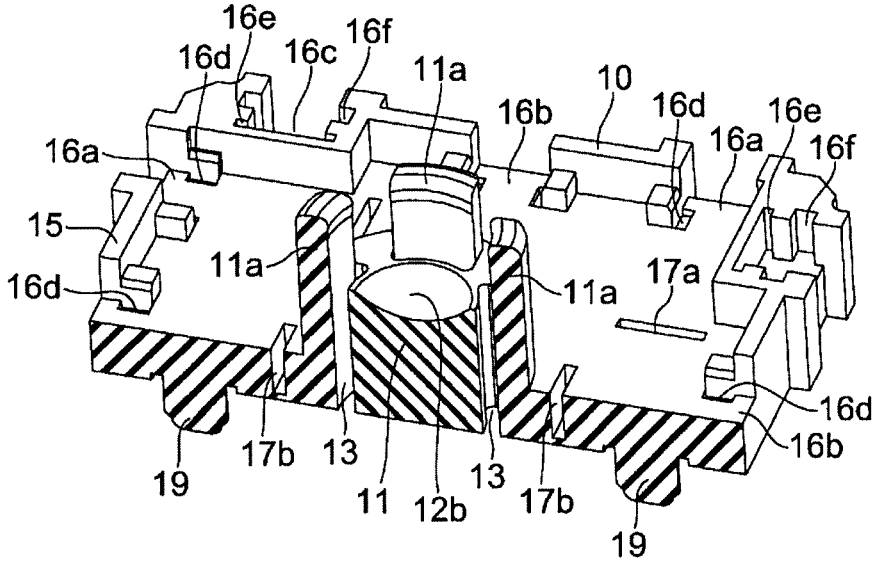
FIG. 28 is a cross-sectional perspective view illustrating the base illustrated in FIG. 27.

That is, as illustrated in FIG. 26, the base 10 is a planar square plate-shaped body, and a bearing body 11 is provided in a protruding manner at the center of the upper surface of the base 10. The bearing body 11 is provided with the bearing part 12*b* having a spherical concave surface shape at the center of the upper end surface thereof. Further, four retaining ribs 11*a* are provided in a protruding manner at equal pitches on the edge of the upper end surface of the bearing body 11. A guide groove 13 penetrating the base 10 is formed along the axial direction in the base of the retaining rib 11*a* (FIG. 28). The guide groove 13 is formed in a place where a core of a molding die for molding the bearing body 11 is disposed.

Figure 27:
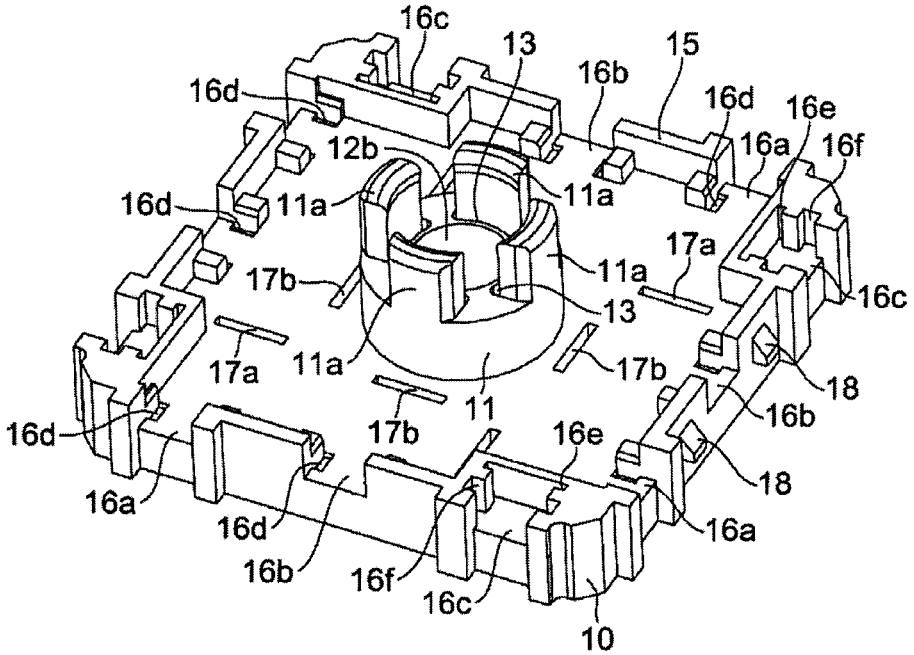
FIG. 27 is a perspective view illustrating a base illustrated in FIG. 26.

As illustrated in FIG. 27, the base 10 has an annular rib 15 formed along the outer peripheral edge of the upper surface thereof. The annular rib 15 is provided with notches 16*a*, 16*b*, 16*c* for respectively assembling a normally open fixed contact terminal 21, a movable contact terminal 25, and a normally closed fixed contact terminal 23 described later.

In particular, storage parts 16*d* are provided at both side corners of the notches 16*a*, 16*b*, respectively. When the normally open fixed contact terminal 21 and the movable contact terminal 25, described later, are assembled to the base 10, the storage part 16*d* can store resin scraps cut out by press-fit protrusions 21*c*, 25*c* (FIG. 29) described later. Further, press-fit grooves 16*e*, 16*f* are formed on the facing inner surfaces of the notch 16*c* (FIG. 28). Press-fit protrusions 23*a* and locking protrusions 23*c* of the normally closed fixed contact terminal 23 can be press-fitted into the press-fit grooves 16*e*, 16*f*.

Figure 29:
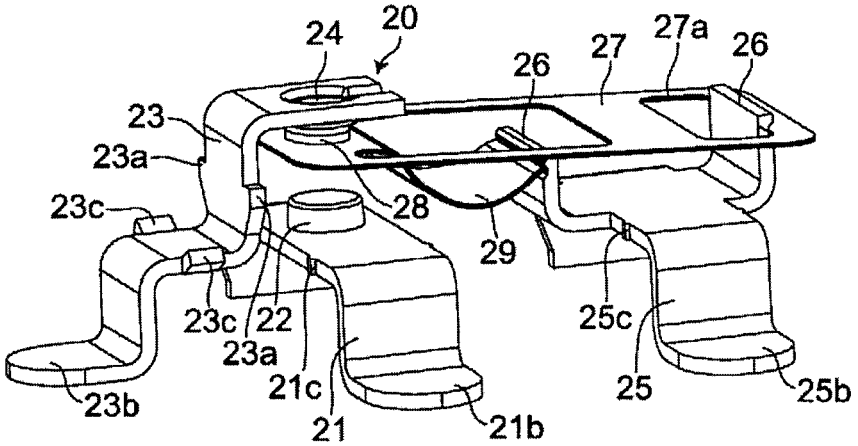
FIG. 29 is a perspective view illustrating a contact mechanism illustrated in FIG. 26.

As illustrated in FIG. 29, a contact mechanism 20 includes the normally open fixed contact terminal 21, the normally closed fixed contact terminal 23, the movable contact terminal 25, and a movable touch piece 27.

In particular, the press-fit protrusions 21*c* and 25*c* are respectively provided in a protruding manner on both side end surfaces of the normally open fixed contact terminal 21 and the movable contact terminal 25.

Figure 30:
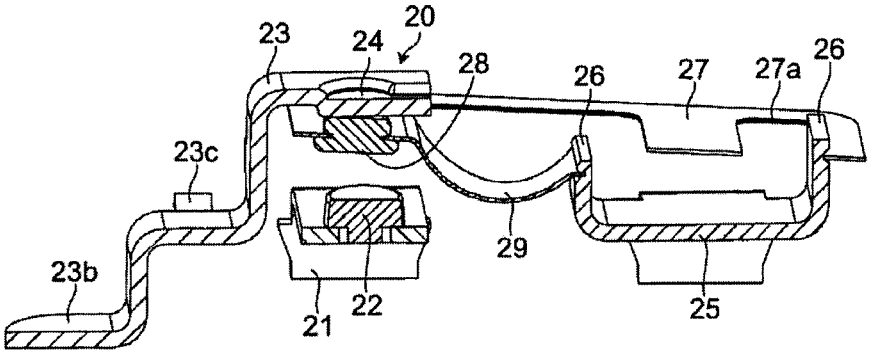
FIG. 30 is a cross-sectional perspective view of the contact mechanism illustrated in FIG. 29.
Figure 31:
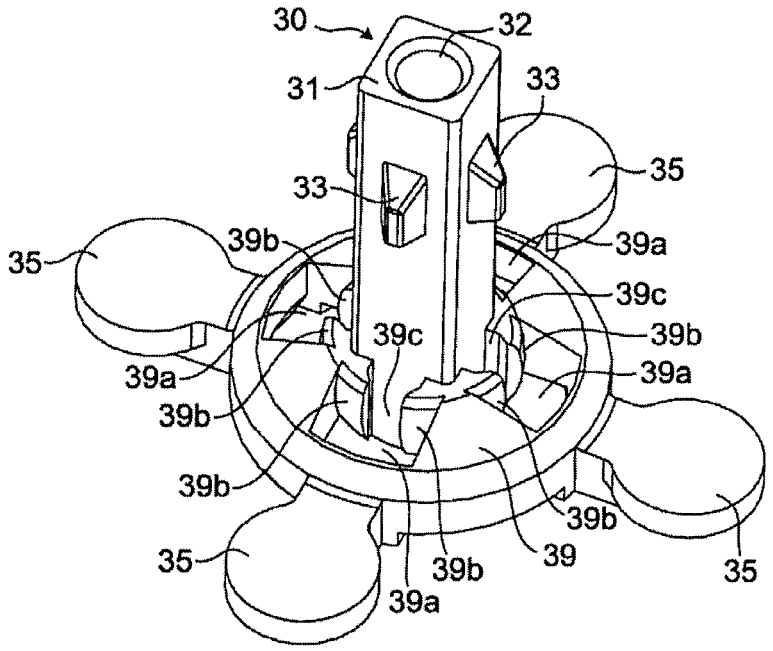
FIG. 31 is a perspective view of an operating lever illustrated in FIG. 26.

The press-fit protrusions 23*a* and locking protrusions 23*c* are provided in a protruding manner on both side end surfaces of the center part of the normally closed fixed contact terminal 23. As illustrated in FIG. 30, the normally closed fixed contact terminal 23 is formed with a normally closed fixed contact 24 by performing a protrusion process on a bent one end. Further, the normally closed fixed contact terminal 23 is bent at the other end thereof to serve as a terminal part 23*b*.

As illustrated in FIG. 26, the operating lever 30 includes an operating shaft 31 having a substantially square shape in cross section, and an insertion hole 32 is formed in the upper end surface of the operating shaft 31. The coil spring 40 and the pressure contact pin 41 are inserted into the insertion hole 32. An engaging claw part 33 is provided in a protruding manner at the upper end of each outer surface of the operating shaft 31.

Figure 32:
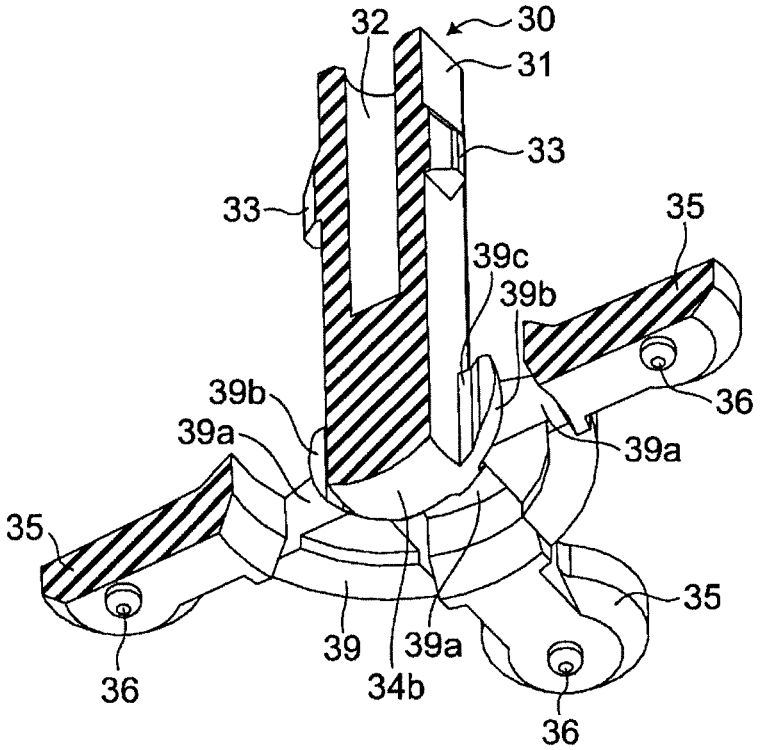
FIG. 32 is a cross-sectional perspective view of the operating lever illustrated in FIG. 31.

As illustrated in FIG. 32, the operating shaft 31 has the spherical convex part 34*b* which can be brought into surface contact with the bearing part 12*b* in the spherical concave surface shape of the bearing body 11 on the lower end surface of the operating shaft 31.

Further, the operating shaft 31 is integrally molded with a connecting part 39 having a substantially disc shape at the lower end thereof. Four operating legs 35 extend laterally at equal pitches from the outer peripheral surface of the connecting part 39. An operating protrusion 36 is provided in a protruding manner on the lower surface of the free end of the operating leg 35.

Further, the connecting part 39 is provided for the four operating legs 35, and fitting holes 39*a* each having a substantially square shape are formed at equal pitches in the base of the operating shaft 31. The fitting hole 39*a* has such a size that the retaining rib 11*a* of the base 10 can be fitted. Further, in the fitting hole 39*a*, an engaging protrusion 39*b* is provided at a corner adjacent to the lower end of the operating shaft 31 in the corner part of the inner peripheral surface. The engaging protrusion 39*b* is continuous with the spherical convex part 34*b* and forms the same spherical surface.

A guide groove 39*c* is formed along the axial direction between the pair of engaging protrusions 39*b*, 39*b* provided in the same fitting hole 39*a*. The guide groove 39*c* is formed in a place where a core of a molding die for molding the engaging claw part 33 is disposed.

As illustrated in FIG. 25, the spherical convex part 34*b* of the operating lever 30 is placed on the bearing part 12*b* of the base 10, so that the retaining rib 11*a* is elastically engaged with the engaging protrusion 39*b*. Thus, the operating lever 30 and the bearing part 12*b* are assembled in a single operation. This can prevent the operating lever 30 from falling off and causing rattling. Further, the operating protrusion 36 of the operating leg 35 is pressed against the movable touch piece 27.

Figure 33:
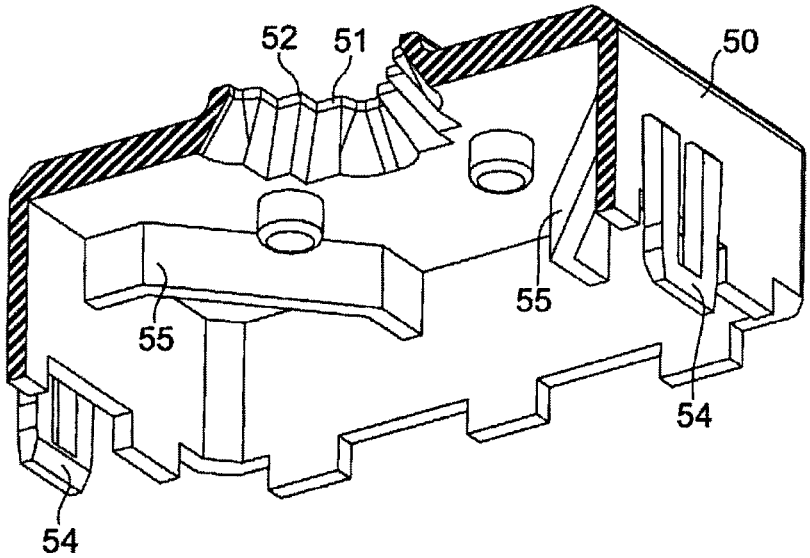
FIG. 33 is a cross-sectional perspective view of the cover illustrated in FIG. 26.
Figure 34:
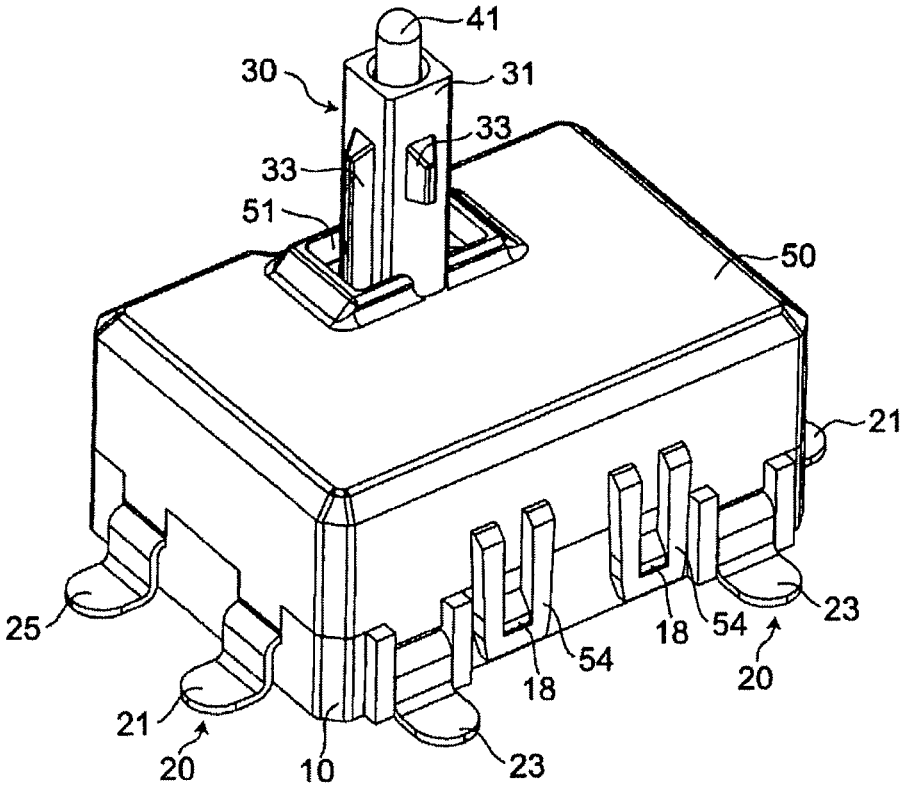
FIG. 34 is a perspective view illustrating a switch of a sixth embodiment according to the present invention.

As illustrated in FIG. 26, the cover 50 is substantially the same as that of the above first embodiment, and has a box shape with a plane that can be fitted to the base 10. The cover 50 is provided with an operating hole 51 having a planar square shape on the ceiling surface thereof. At each corner of the operating hole 51, a position regulating protrusion 52 is provided. However, as illustrated in FIG. 33, the inner surface of the operating hole 51 is an inclined surface divergent toward the inside. This is to facilitate die-cutting work of the mold during molding.

The other parts of the fifth embodiment are substantially the same as those of the first embodiment described above, and hence the same reference numerals are provided to the same parts, and the description thereof is omitted.

As illustrated in FIGS. 34 to 40, a sixth embodiment illustrates a switch that is operable in two directions, and is substantially the same as in the above third embodiment. The sixth embodiment differs from the third embodiment described above in that as illustrated in FIG. 35, a bearing part 12*c* having a curved concave surface shape, for example, a semicircular groove shape in cross section, provided in a bearing body 11 of a base 10, and supports a cylindrical convex part 34*c* provided on an operating lever 30.

Figure 37:
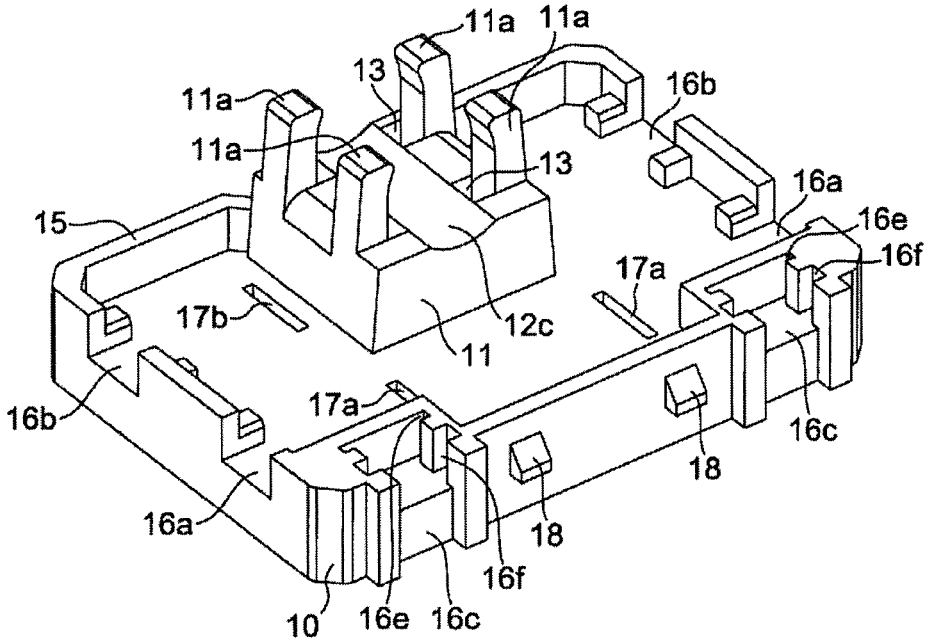
FIG. 37 is a perspective view illustrating a base illustrated in FIG. 36.
Figure 38:
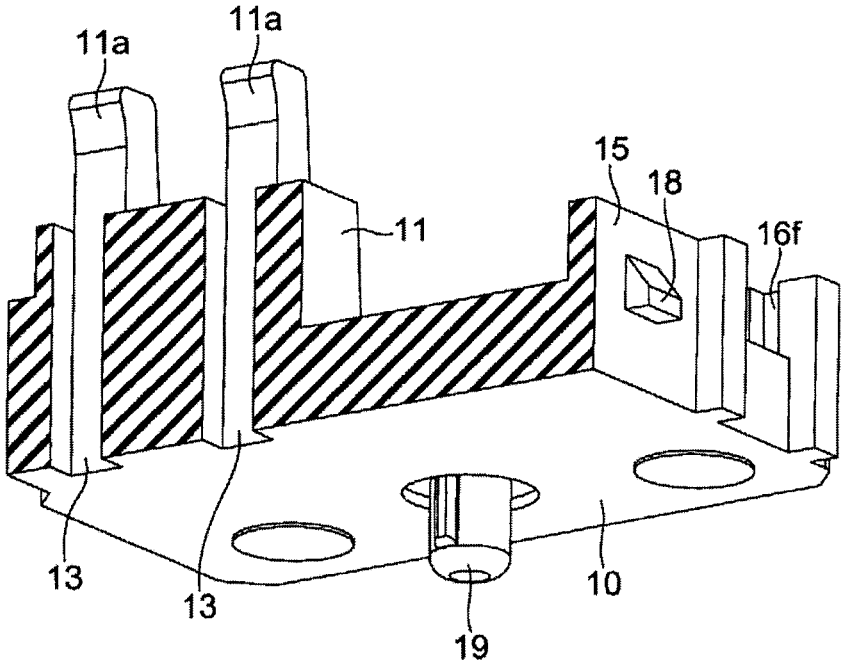
FIG. 38 is a cross-sectional perspective view illustrating the base illustrated in FIG. 37.

As illustrated in FIGS. 37 and 38, the base 10 is a planar square plate-shaped body, and the bearing body 11 having a planar square shape is provided in a protruding manner on the upper surface thereof. The bearing body 11 is provided with the bearing part 12*c* having a semicircular groove shape in cross section at the center of the upper end surface thereof. Four retaining ribs 11*a* are provided in a protruding manner at the corners of the upper end surface of the bearing body 11. A guide groove 13 penetrating the base 10 is formed in the base of the retaining rib 11*a* along the axial direction. The guide groove 13 is formed in a place where a core of a molding die for molding the bearing body 11 is disposed.

Figure 35:
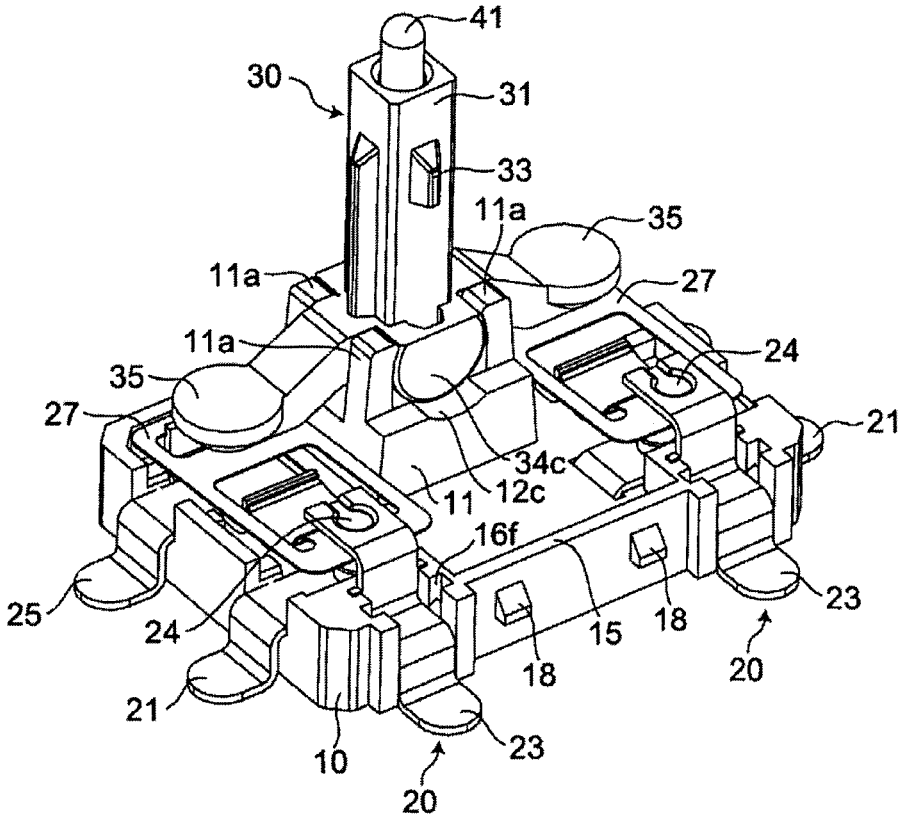
FIG. 35 is a perspective view illustrating a state where a cover has been removed from the switch illustrated in FIG. 34.
Figure 36:
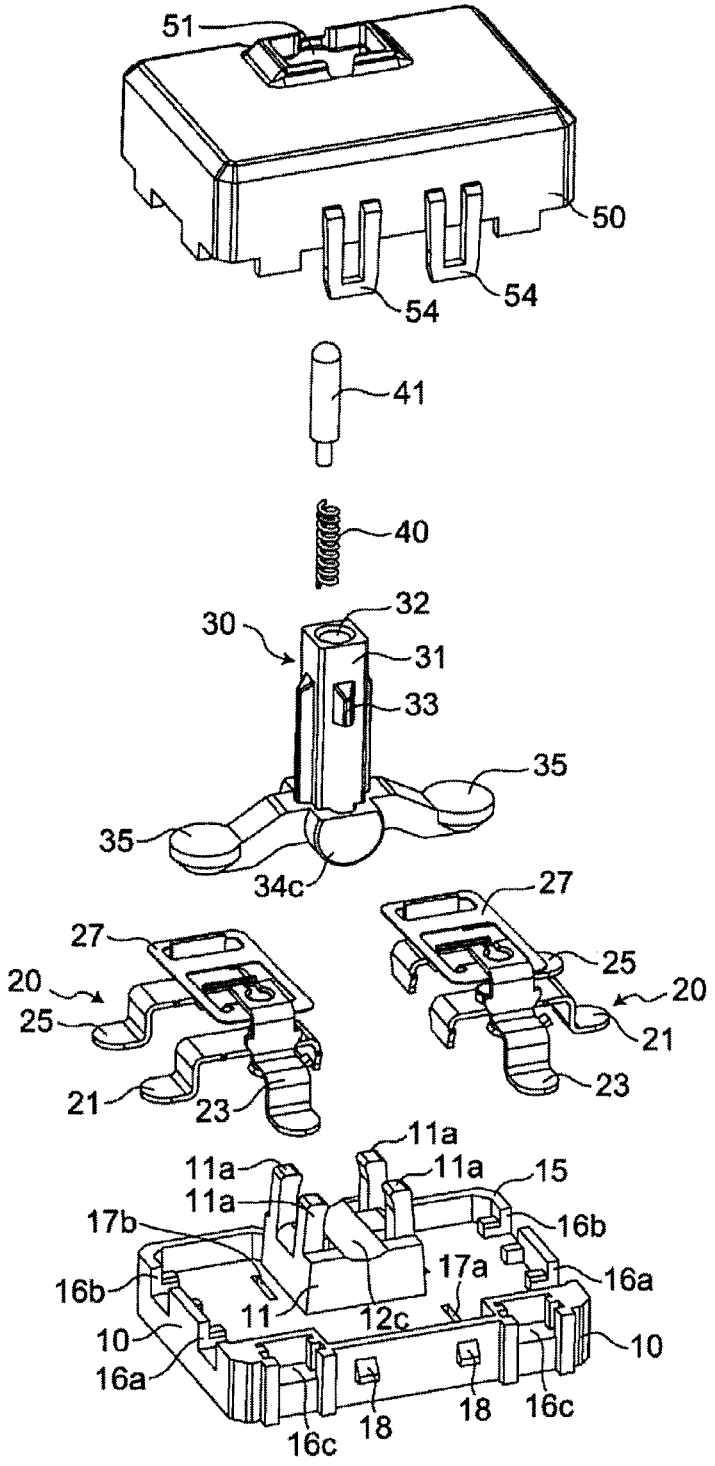
FIG. 36 is an exploded perspective view of the switch illustrated in FIG. 34.

As illustrated in FIGS. 35 and 36, a contact mechanism 20 includes a normally open fixed contact terminal 21, a normally closed fixed contact terminal 23, a movable contact terminal 25, and a movable touch piece 27. The other parts of the sixth embodiment are substantially the same as those of the first embodiment described above, and hence the same reference numerals are provided to the same parts, and the description thereof is omitted.

As illustrated in FIG. 36, the operating lever 30 includes an operating shaft 31 having a substantially square shape in cross section, and an insertion hole 32 is provided in the upper end surface of the operating shaft 31. The coil spring 40 and the pressure contact pin 41 are inserted into the insertion hole 32. An engaging claw part 33 is provided in a protruding manner at the upper end of each outer surface of the operating shaft 31.

Figure 39:
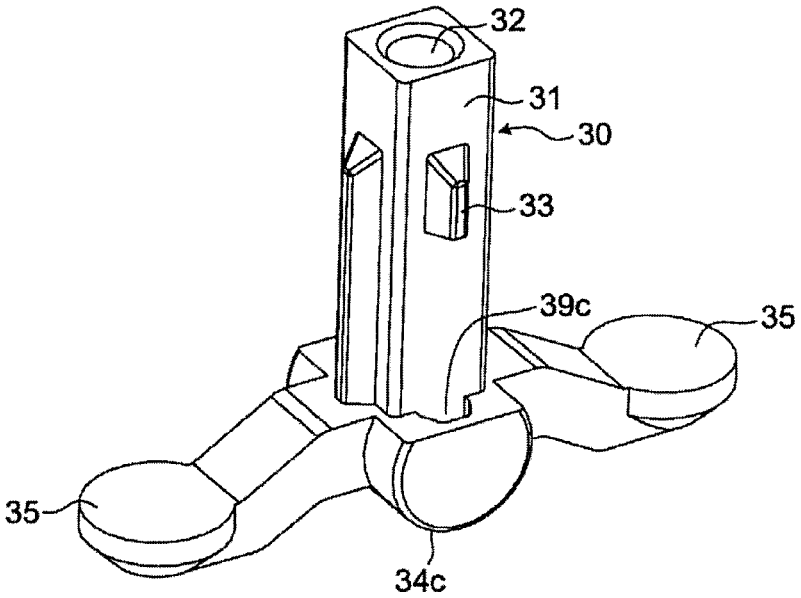
FIG. 39 is a perspective view of an operating lever illustrated in FIG. 36.
Figure 40:
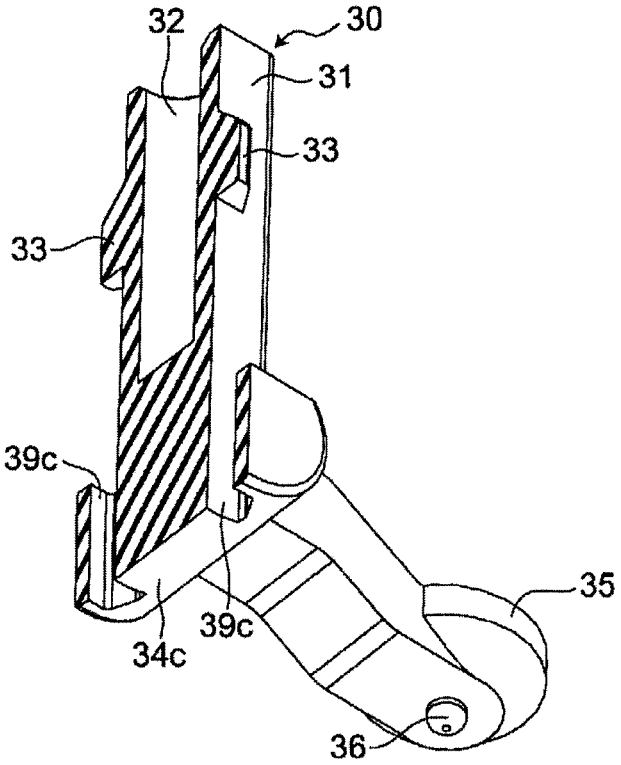
FIG. 40 is a cross-sectional perspective view of the operating lever illustrated in FIG. 39.
Figure 41:
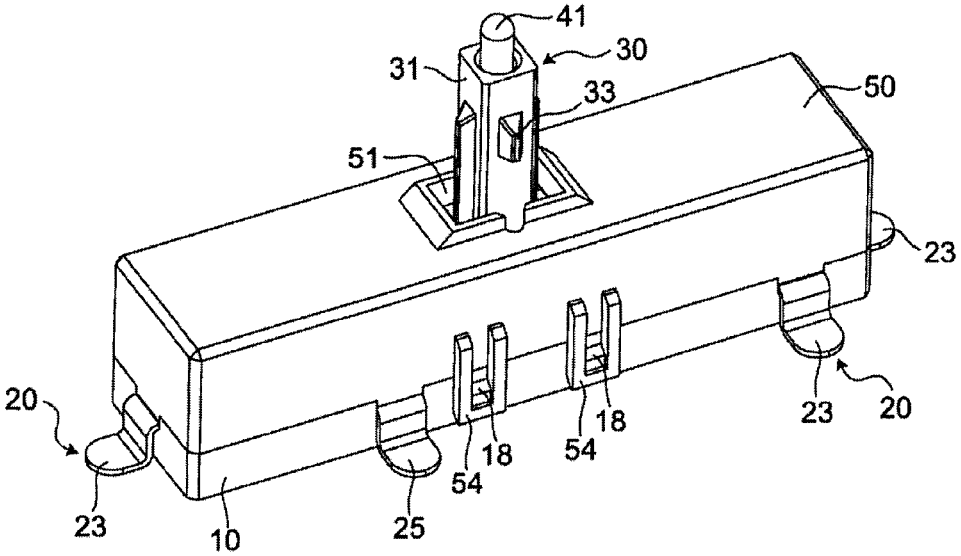
FIG. 41 is a perspective view illustrating a switch of a seventh embodiment according to the present invention.

As illustrated in FIG. 39, the operating shaft 31 has the cylindrical convex part 34*c* which can be brought into surface contact with the bearing part 12*c* of the bearing body 11 on the lower end surface of the operating shaft 31. Furthermore, the operating shaft 31 is provided with two operating legs 35, 35 at the lower end thereof. The operating legs 35, 35 extend obliquely downward in a direction orthogonal to the axial direction of the cylindrical convex part 34*c*. An operating protrusion 36 is provided in a protruding manner on the lower surface of the free end of the operating leg 35 (FIG. 40).

Then, as illustrated in FIG. 35, the cylindrical convex part 34*c* of the operating lever 30 is fitted to the bearing part 12*c* of the base 10, so that the retaining rib 11*a* is elastically engaged to the linear base of the cylindrical convex part 34*c*. Thus, the operating lever 30 and the bearing part 12*c* are assembled in a single operation. This can prevent the operating lever 30 from falling off and causing rattling. Further, the operating protrusion 36 of the operating leg 35 is pressed against the movable touch piece 27.

Figure 42:
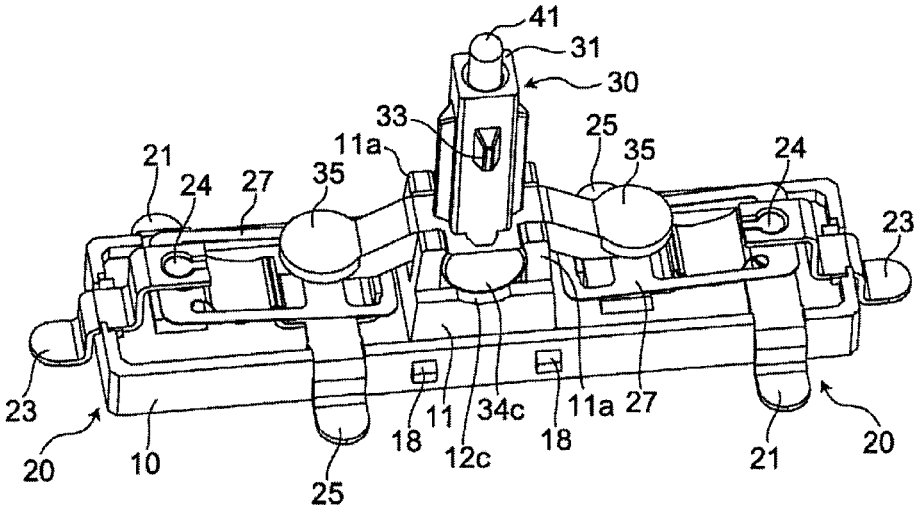
FIG. 42 is a perspective view illustrating a state where a cover has been removed from the switch illustrated in FIG. 41.
Figure 43:
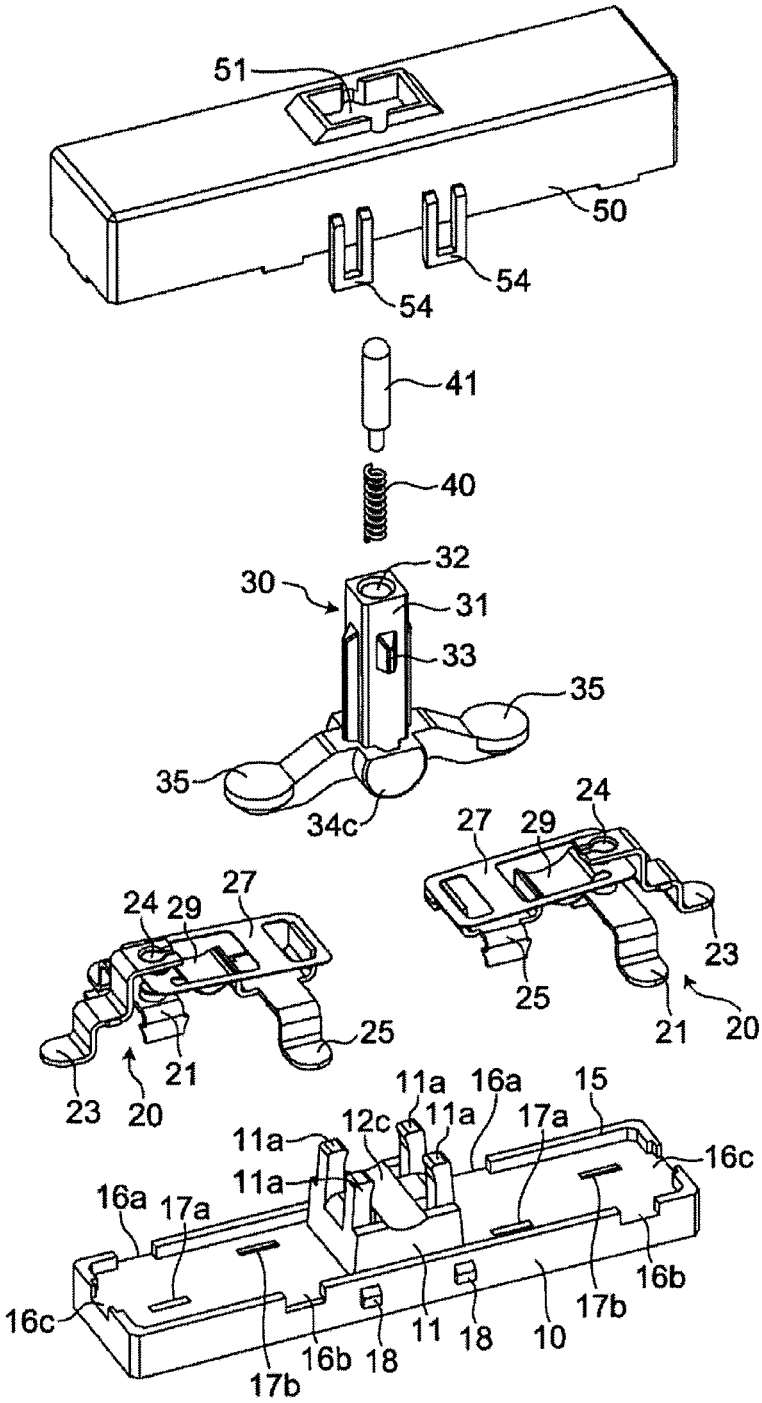
FIG. 43 is an exploded perspective view of the switch illustrated in FIG. 41.
Figure 44:
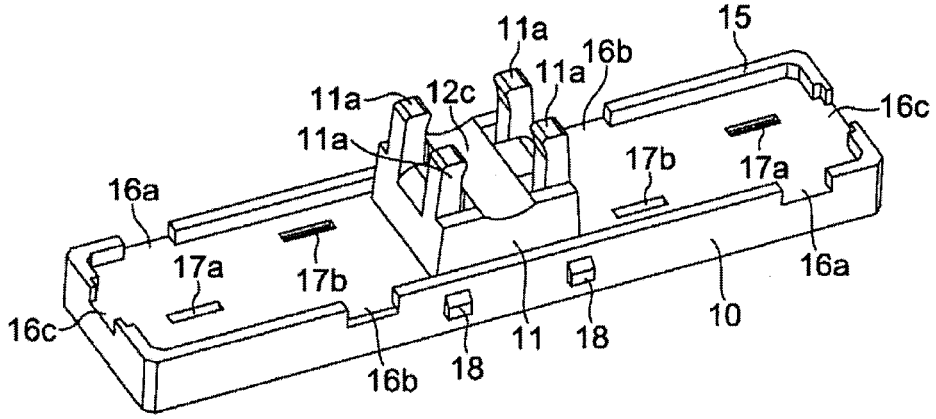
FIG. 44 is a perspective view illustrating a base illustrated in FIG. 43.
Figure 45:
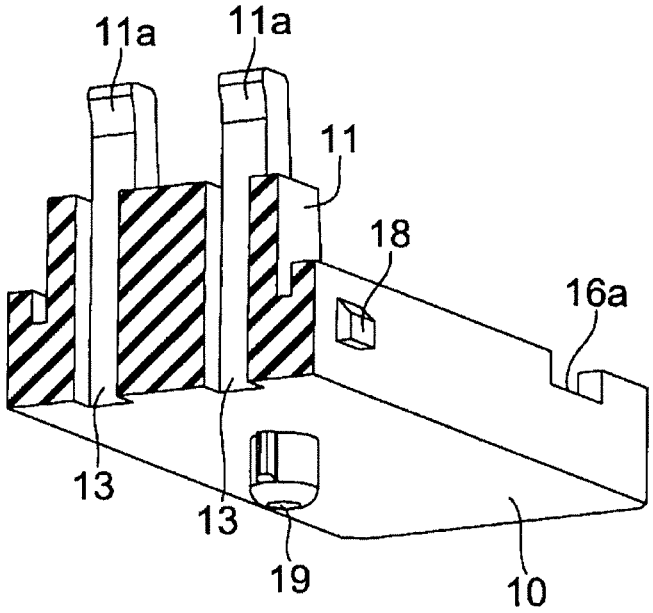
FIG. 45 is a cross-sectional perspective view illustrating the base illustrated in FIG. 44.
Figure 46:
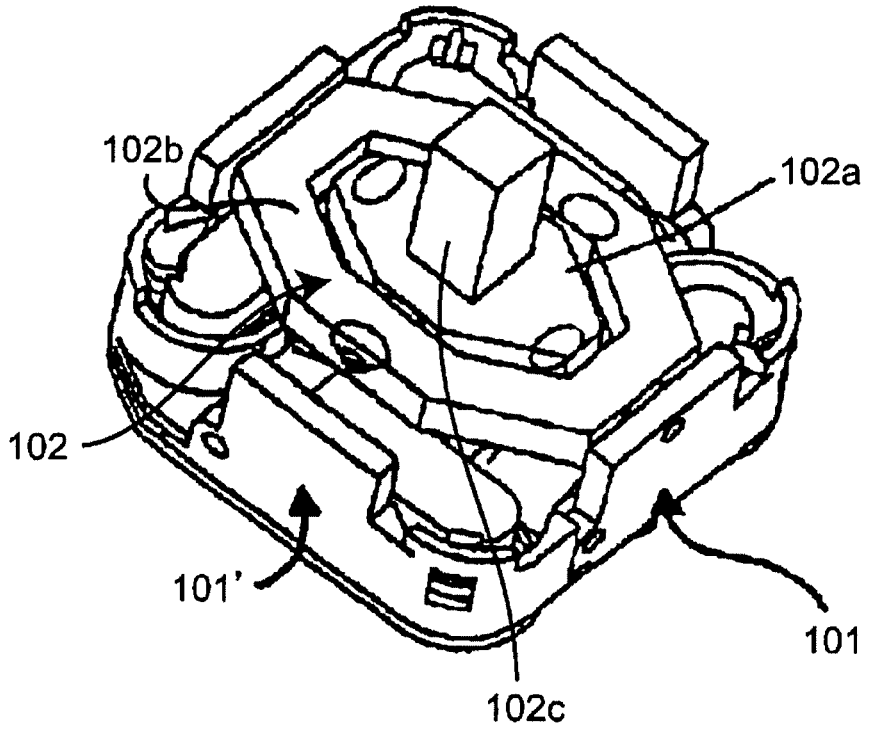
Fig. 46 Prior Art
FIG. 46 is a perspective view of a multi-directional switch assembly and a switch module of Patent Document 1.

A seventh embodiment illustrates a switch that is operable in two directions as illustrated in FIGS. 41 to 45. The difference from the above sixth embodiment is that, as illustrated in FIG. 42, an operating leg 35 of an operating lever 30 and contact mechanisms 20, 20 are arranged on the same straight line along the extending direction of the operating leg 35.

The other parts of the seventh embodiment are substantially the same as those of the sixth embodiment described above, and hence the same reference numerals are provided to the same parts, and the description thereof is omitted.

According to the seventh embodiment, there is an advantage that an elongated switch can be obtained.

As a modification of the seventh embodiment, for example, only one contact mechanism 20 may be assembled to a base 10.

A variety of embodiments of the present invention have been described in detail with reference to the drawings, and lastly, a variety of aspects of the present invention will be described.

According to the above one aspect of the present invention, even when the mounting position of the base is limited, by extending the operating leg of the operating lever in a desired direction, it is possible to arbitrarily select the operating direction. Hence a versatile switch with high design flexibility can be obtained.

In the aspect of the present invention, the contact surface on which the bearing part and the lower end surface of the operating shaft come into contact may be formed in a curved surface shape. For example, other than making the bearing part and the lower end surface of the operating shaft the combination of the curved convex surface and the curved concave surface, it is possible to make them a combination of a spherical convex surface and a spherical concave surface.

As one aspect of the present invention, in the above aspect, the contact surface on which the bearing part and the lower end surface of the operating shaft come into contact may have a spherical surface shape.

As another aspect of the present invention, in the above aspect, the bearing part may have a spherical convex shape, and a spherical concave part that comes into surface contact with the bearing part of the spherical convex shape may be provided on the lower end surface of the operating shaft.

According to this aspect, the spherical concave part of the operating shaft comes into surface contact with the bearing part having a spherical convex shape. For this reason, the operating shaft can be rotated in multiple directions while ensuring a stable contact state, and hence a large number of contact mechanisms can be operated.

As another aspect of the present invention, in the above aspect, a retaining rib that is elastically engaged with the annular base of the bearing part having the spherical convex shape may be provided on the outer peripheral edge of the spherical concave part.

According to this aspect, it is possible to assemble the operating lever to the bearing body in a single operation. Hence it is possible to obtain a switch with good assemblability and higher productivity.

As a different aspect of the present invention, in the above aspect, when the operating shaft is rotated in a direction other than a predetermined direction (e.g., an operable direction), a position regulating rib that comes into contact with the support receiving part for positional regulation may be provided on the operating shaft, the support receiving part being provided on the outer peripheral surface of the bearing body.

According to this aspect, when the operating shaft is rotated in a direction other than the predetermined direction, the position regulating rib of the operating shaft comes into contact with the support receiving part of the bearing body, and the position of the operating shaft is regulated. Therefore, erroneous operation of the operating lever can be prevented, and a switch with high safety can be obtained.

As another aspect of the present invention, in the above aspect, the bearing part may have a curved concave surface shape.

As another aspect of the present invention, in the above aspect, the curved concave surface shape of the bearing part may be a spherical concave surface shape, and a spherical convex part that comes into surface contact with the bearing part having the spherical concave surface shape may be provided on the lower end surface of the operating shaft.

According to this aspect, the spherical convex part of the operating shaft comes into surface contact with the bearing part having the spherical concave surface shape. For this reason, the operating shaft can be rotated in multiple directions while ensuring a stable contact state, and hence a large number of contact mechanisms can be operated.

As another aspect of the present invention, in the above aspect, the curved concave surface shape of the bearing part has a semicircular groove shape in cross section, and a cylindrical convex part that comes into surface contact with the bearing part having the semicircular groove shape in cross section may be provided on the lower end surface of the operating shaft.

According to this aspect, since the cylindrical convex part is provided on the lower end surface of the operating shaft, the contact area is large and stable operation becomes possible.

As a different aspect of the present invention, in the above aspect, a retaining rib, elastically engaged with the annular base of the spherical convex part, may be provided on the outer peripheral edge of the bearing part of the upper end of the bearing body.

According to this aspect, it is possible to assemble the operating lever to the bearing body in a single operation. Hence it is possible to obtain a switch with good assemblability and higher productivity.

As another aspect of the present invention, in the above aspect, a retaining rib, elastically engaged with the linear base of the cylindrical convex part, may be provided on the outer peripheral edge of the bearing part of the upper end of the bearing body.

According to this aspect, it is possible to assemble the operating lever to the bearing body in a single operation. Hence it is possible to obtain a switch with good assemblability and higher productivity.

As a difference aspect of the present invention, in the above aspect, a cover that is fitted to the base may be further provided, an operating hole, from which the operating lever operably protrudes, may be formed in a ceiling surface of the cover, and an opening edge of the operating hole may be provided with a position regulating protrusion that comes into contact with the operating lever for positional regulation when the operating lever is rotated in a direction other than a predetermined direction.

According to this aspect, when the operating lever is operated in a direction other than the predetermined direction, the operating lever comes into contact with the position regulating protrusion provided at the opening edge of the operating hole to regulate the position of the operating lever. Hence there is an advantage of being able to prevent erroneous operation of the operating lever, and obtaining a switch with even higher safety.

It is to be noted that by combining arbitrary aspects, embodiments, or modifications of the variety of aspects, embodiments, or modifications as appropriate, it is possible to achieve the respective effects of those combined. It is also possible to combine aspects or embodiments, combine examples, or combine aspects or embodiments and examples, and it is also possible to combine features in different aspects or embodiments or examples.

While the present invention has been fully described in connection with the foregoing embodiments and the like with reference to the accompanying drawings, a variety of modifications or corrections will be apparent to those skilled in the art. Such modifications or corrections are to be understood as being included in the scope of the invention according to the appended claims so long as not deviating therefrom.

INDUSTRIAL APPLICABILITY

The switch according to the present invention is not limited to the above embodiment, and for example, it is natural that the operating lever may have three, five or seven operating legs.

DESCRIPTION OF SYMBOLS

10 base
11 bearing body
12 bearing part
12*b* bearing part
12*c* bearing part
13 guide groove
14 support receiving part
15 annular rib
16*a* notch
16*b* notch
16*c* notch
18 locking protrusion
19 positioning protrusion
20 contact mechanism
21 normally open fixed contact terminal
22 normally open fixed contact
23 normally closed fixed contact terminal
24 normally closed fixed contact
25 movable contact terminal
26 rising piece
26*a* locking groove
26*b* locking groove
27 movable touch piece
28 movable contact
29 inversion spring
29*a* free end
30 operating lever
31 operating shaft
32 insertion hole
33 engaging claw part
34 spherical concave part
34*b* spherical convex part
34*c* cylindrical convex part
35 operating leg
36 operating protrusion
37 retaining rib
38 position regulating rib
40 coil spring
41 pressure contact pin
50 cover
51 operating hole
52 position regulating protrusion
53 fitting protrusion
54 locking part
55 Partition wall
60 operating body
61 engaging arm

The invention claimed is:

1. A switch comprising:

a base on which a bearing body having a bearing part at an upper end is provided in a protruding manner;

an operating lever having an operating shaft with a lower end surface rotatably supported by the bearing part, and at least one operating leg extending from the operating shaft toward the base; and at least one contact mechanism having a fixed contact and a movable contact movable by the operating leg during rotation of the operating shaft, the contact mechanism being disposed on an upper surface of the base, with the movable contact opened and closed by the operating leg with respect to the fixed contact, wherein the bearing part has a curved concave surface shape, wherein the curved concave surface shape of the bearing part is a semicircular groove shape in cross section, and wherein a cylindrical convex part that comes into surface contact with the bearing part having the semicircular groove shape in cross section is provided on the lower end surface of the operating shaft, and wherein a retaining rib, elastically engaged with a linear base of the cylindrical convex part, is provided on an outer peripheral edge of the bearing part of the upper end of the bearing body.

2. The switch according to claim 1, further comprising:

a cover that is fitted to the base, wherein an operating hole, from which the operating lever operably protrudes, is formed in a ceiling surface of the cover, and wherein an opening edge of the operating hole is provided with a position regulating protrusion that comes into contact with the operating lever for positional regulation when the operating lever is rotated in a direction other than a predetermined direction.

3. The switch according to claim 1, wherein the operating shaft is provided with a position regulating rib that comes into contact with a support receiving part provided on an outer peripheral surface of the bearing body for positional regulation when the operating shaft is rotated in a direction other than a predetermined direction.

4. The switch according to claim 3, further comprising:

a cover that is fitted to the base, wherein an operating hole, from which the operating lever operably protrudes, is formed in a ceiling surface of the cover, and wherein an opening edge of the operating hole is provided with a position regulating protrusion that comes into contact with the operating lever for positional regulation when the operating lever is rotated in a direction other than a predetermined direction.

5. The switch according to claim 1, wherein the curved concave surface shape of the bearing part is a spherical concave surface shape, and wherein a spherical convex part that comes into surface contact with the bearing part having the spherical concave surface shape is provided on the lower end surface of the operating shaft.

6. The switch according to claim 5, wherein a retaining rib, elastically engaged with an annular base of the spherical convex part, is provided on an outer peripheral edge of the bearing part of the upper end of the bearing body.

7. The switch according to claim 1, wherein a contact surface on which the bearing part and the lower end surface of the operating shaft come into contact has a spherical surface shape.

8. The switch according to claim 7, wherein the bearing part has a spherical convex shape, and wherein a spherical concave part that comes into surface contact with the bearing part of the spherical convex shape may be provided on the lower end surface of the operating shaft.

9. The switch according to claim 7, wherein the operating shaft is provided with a position regulating rib that comes into contact with a support receiving part provided on an outer peripheral surface of the bearing body for positional regulation when the operating shaft is rotated in a direction other than a predetermined direction.

10. The switch according to claim 7, further comprising:

a cover that is fitted to the base, wherein an operating hole, from which the operating lever operably protrudes, is formed in a ceiling surface of the cover, and wherein an opening edge of the operating hole is provided with a position regulating protrusion that comes into contact with the operating lever for positional regulation when the operating lever is rotated in a direction other than a predetermined direction.

11. The switch according to claim 1, wherein the bearing part has a spherical convex shape, and wherein a spherical concave part that comes into surface contact with the bearing part of the spherical convex shape may be provided on the lower end surface of the operating shaft.

12. The switch according to claim 11, wherein the operating shaft is provided with a position regulating rib that comes into contact with a support receiving part provided on an outer peripheral surface of the bearing body for positional regulation when the operating shaft is rotated in a direction other than a predetermined direction.

13. The switch according to claim 11, further comprising:

a cover that is fitted to the base, wherein an operating hole, from which the operating lever operably protrudes, is formed in a ceiling surface of the cover, and wherein an opening edge of the operating hole is provided with a position regulating protrusion that comes into contact with the operating lever for positional regulation when the operating lever is rotated in a direction other than a predetermined direction.

14. The switch according to claim 11, wherein a retaining rib, elastically engaged with an annular base of the bearing part having the spherical convex shape, is provided on an outer peripheral edge of the spherical concave part.

15. The switch according to claim 14, wherein the operating shaft is provided with a position regulating rib that comes into contact with a support receiving part provided on an outer peripheral surface of the bearing body for positional regulation when the operating shaft is rotated in a direction other than a predetermined direction.

16. The switch according to claim 14, further comprising:

a cover that is fitted to the base, wherein an operating hole, from which the operating lever operably protrudes, is formed in a ceiling surface of the cover, and wherein an opening edge of the operating hole is provided with a position regulating protrusion that comes into contact with the operating lever for positional regulation when the operating lever is rotated in a direction other than a predetermined direction.

* * * * *